United States Patent [19]

Watanabe et al.

[11] Patent Number: 4,699,501

[45] Date of Patent: Oct. 13, 1987

[54] IMAGE FORMING APPARATUS WITH AN OPERATION PANEL CONTROL FUNCTION

[75] Inventors: Junji Watanabe; Kozo Matsuyama, both of Yokohama, Japan

[73] Assignee: Kabushiki Kaisha Toshiba, Kawasaki, Japan

[21] Appl. No.: 825,911

[22] Filed: Feb. 4, 1986

[30] Foreign Application Priority Data

| | | | |
|---|---|---|---|
| Feb. 6, 1985 | [JP] | Japan | 60-21083 |
| Feb. 20, 1985 | [JP] | Japan | 60-30504 |
| Feb. 20, 1985 | [JP] | Japan | 60-30505 |
| Feb. 26, 1985 | [JP] | Japan | 60-36977 |

[51] Int. Cl.[4] ..... G03G 15/00

[52] U.S. Cl. ..... 355/14 R; 355/14 C; 364/518

[58] Field of Search ..... 355/14 R, 14 C, 6, 8; 364/518

[56] References Cited

U.S. PATENT DOCUMENTS

| | | | |
|---|---|---|---|
| 4,298,269 | 11/1981 | Yoshimara et al. | 355/14 R X |
| 4,393,375 | 12/1983 | Sugiura et al. | 355/14 R X |
| 4,475,806 | 10/1984 | Daughton et al. | 355/14 C X |

FOREIGN PATENT DOCUMENTS

| | | | |
|---|---|---|---|
| 58-127943 | 7/1983 | Japan | 355/14 C |
| 58-208740 | 12/1983 | Japan | 355/14 C |

*Primary Examiner*—Arthur T. Grimley

*Assistant Examiner*—J. Pendegrass

*Attorney, Agent, or Firm*—Schwartz, Jeffery, Schwaab, Mack, Blumenthal & Evans

[57] ABSTRACT

An image forming apparatus with an operation panel control function, the apparatus has a housing including an original scanning section for optically scanning an original placed on an original table so as to obtain optical image data, an image forming section for transferring the optical image data obtained by the original scanning section onto an image forming medium, an operation panel arranged on the housing and having an operation section for supplying various operation instructions to the original scanning section and the image forming section included in the housing, an operation data supply section which is detachably mounted on the operation panel, stores operation data associated with the various operation instructions, and has a data recording medium from which the storage data can be read out as desired, a display section which is arranged on the operation panel and can display at least the operation data written in the data recording medium of the operation data supply section, and a control section connected to the original scanning section and the image forming section included in the housing, the operation section of the operation panel, the operation data supply section, and the display section so as to communicate a control signal containing the operation data therewith.

6 Claims, 65 Drawing Figures

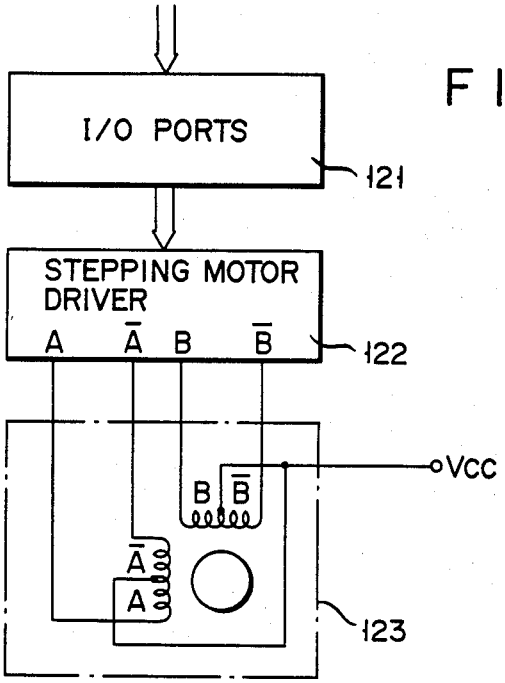
FIG. 14
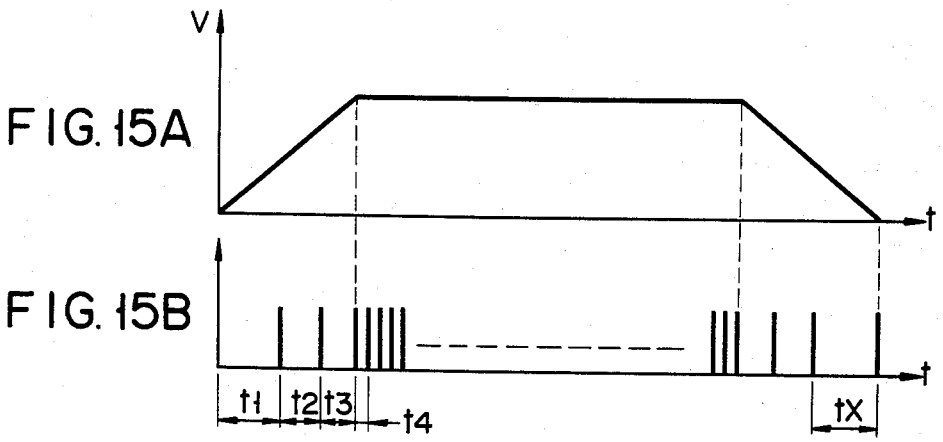
FIG. 15A
FIG. 15B

IMAGE FORMING APPARATUS WITH AN OPERATION PANEL CONTROL FUNCTION

BACKGROUND OF THE INVENTION

This invention relates to an image forming apparatus with an operation panel control function and, more particularly, to an image forming apparatus suitable for an electronic copying machine which allows easy operation and multi-functions.

As is well known, recent copying machines have become increasingly multi-functioned, and a large number of operation keys are arranged on their operation panels, resulting in complex operation. For this reason, when an operator is not familiar with the machine, he often makes errors in copying, thus wasting time and increasing costs.

The functions of various keys on an operation panel are indicated thereon or therearound. Because of this, Japanese or English instruction messages must be prepared to correspond with a possible customer demand. This results in an increase in the number of apparatus parts and complicates parts-control.

Since recent copying machines have multi-functions, they can be selectively connected to optional devices such as an automatic original feeder, a sorter, and the like.

A conventional electronic copying machine connectable to various optional devices is provided with a plurality of switches for starting or stopping these optional devices, thus complicating the operation panel appearance and its operation.

The above-mentioned copying machines with multi-functions have a complex internal structure. For this reason, when a copying machine is purchased and is operated for the first time, it must be operated while referring to an operation manual.

Various names and operation instructions of various operation keys are normally printed on the operation panel of an electronic copying machine. However, these names are expressed only in Japanese if the machine is for domestic use only. For this reason, it is inconvenient for those who cannot read Japanese to use such a copying machine.

SUMMARY OF THE INVENTION

It is, therefore, an object of the present invention to provide a new and improved image forming apparatus with an operation panel control function, which can provide multi-functions by easy operation.

It is another object of the present invention to provide an image forming apparatus which can decrease the number of operation keys so as to simplify its operation and parts-control, while still providing multi-functions.

It is still another object of the present invention to provide an image forming apparatus which can simplify an arrangement of an operation panel even if optional devices are connected thereto, so as to allow easy operation, thereby preventing erroneous operation.

It is still another object of the present invention to provide an image forming apparatus which has easily understood of installation/setup procedures, and can shorten the time required therefor.

It is still another object of the present invention to provide an image forming apparatus which can display operation messages or guides in a desired language, resulting in practical advantages.

For example, according to the present invention, a quick disk device, a liquid crystal dot matrix display section, and a plurality of operation keys surrounding the display section are arranged on an operation panel, whereby display data stored in the quick disk device is displayed on the display section in accordance with a display mode. In this way, functions of operation keys are changed to correspond to the displayed content.

In addition, operation guide data for optional devices (e.g., automatic original feeder, sorter, and the like) are prestored in the quick disk device. Among the operation guide data stored, the data corresponding to the optional device connected to the image forming apparatus is read out from the disk device and is displayed on the display section. When a setting key corresponding to the displayed message is depressed, the optional device can be started or stopped.

Furthermore, according to the present invention, a quick disk device and a dot matrix display are arranged on a copying machine housing, and a quick disk storing installation/setup manual data is loaded in the quick disk device, so as to display the content of the disk, thereby shortening installation/setup time.

In addition, according to the present invention, when a quick disk storing operation guides in different languages is loaded in the quick disk device, the operation guide can be displayed in a desired language.

According to the present invention, there is provided an image forming apparatus with an operation panel control function, the apparatus comprising:

a housing including original scanning means for optically scanning an original placed on an original table so as to obtain optical image data, and image forming means for transferring the optical image data obtained by the original scanning means onto an image forming medium;

an operation panel arranged on the housing and having operation means for supplying various operation instructions to the original scanning means and the image forming means included in the housing;

operation data supply means which is detachably mounted on the operation panel, stores operation data associated with the various operation instructions, and has a data recording medium from which the storage data can be read out as desired;

display means which is arranged on the operation panel and can display at least the operation data written in the data recording medium of the operation data supply means; and control means connected to the original scanning means and the image forming means included in the housing, the operation means of the operation panel, the operation data supply means, and the display means so as to communicate a control signal containing the operation data therewith.

BRIEF DESCRIPTION OF THE DRAWINGS

These and other objects and features of the present invention can be understood through the following embodiment by reference to the accompanying drawings.

FIGS. 1 to 31 show an embodiment of an image forming apparatus according to the present invention, in which:

FIGS. 1 to 3 are schematic perspective views of the image forming apparatus;

FIG. 4 is a side sectional view showing a main part of FIG. 3;

FIG. 5 is a side sectional view showing the construction of the image forming apparatus;

FIG. 6 is a plan view showing an arrangement of a control panel;

FIG. 7 is a perspective view of drive sections;

FIG. 8 is a schematic perspective view of a drive mechanism for an optical system;

FIG. 9 is a schematic perspective view of a drive mechanism for indexes;

FIG. 10 is a block diagram of an overall control circuit;

FIG. 11 is a block diagram of a main processor group;

FIG. 12 is a block diagram of a first sub-processor group;

FIG. 13 is a block diagram of a second subprocessor group;

FIG. 14 is a schematic block diagram showing a control circuit for a pulse motor;

FIGS. 15A and 15B are illustrations for explaining a speed control method of a pulse motor;

FIG. 16 is a perspective view of a main part of a spot light source;

FIG. 17 is a side sectional view of FIG. 16;

FIG. 18 and FIGS. 19A and 19B are plan views for explaining an erasure area specifying operation on an original using the spot light source;

FIGS. 22 and 23 show the positional relationship between the erasure array and a photosensitive drum, in which FIG. 22 is a perspective view, and FIG. 23 is a front view showing the main part of the arrangement;

FIG. 25 is a circuit diagram showing an arrangement of an array drive section;

FIGS. 26A to 26H, 26I-1, 26I-2 and 26J and FIGS. 27A-1, 27A-2 and 27B are flow charts for explaining the operation of the image forming apparatus;

FIG. 29 is a plan view for explaining the erasure area display operation;

FIG. 31 is a block diagram of a control circuit of the optional devices;

DETAILED DESCRIPTION OF THE PREFERRED EMBODIMENT

An embodiment of the present invention will now be described with reference to the accompanying drawings.

Figure 1:
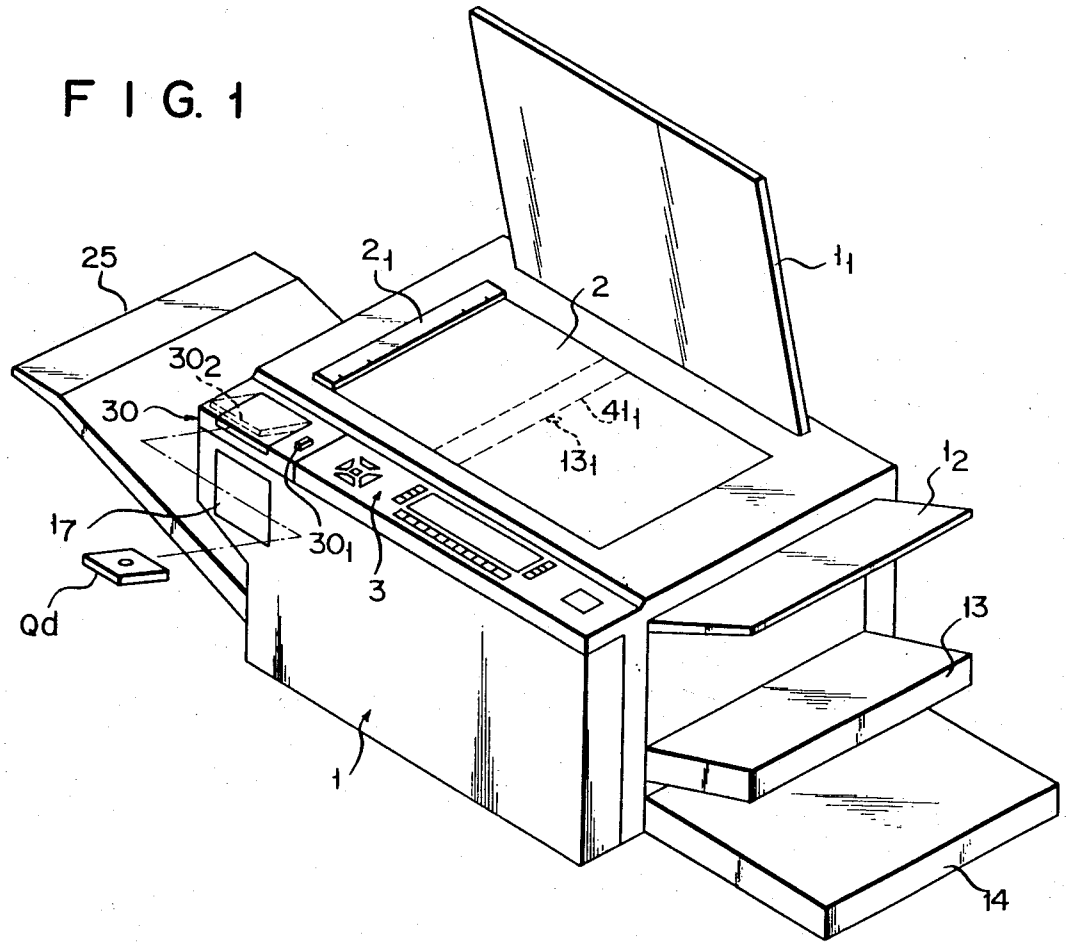
Figure 2:
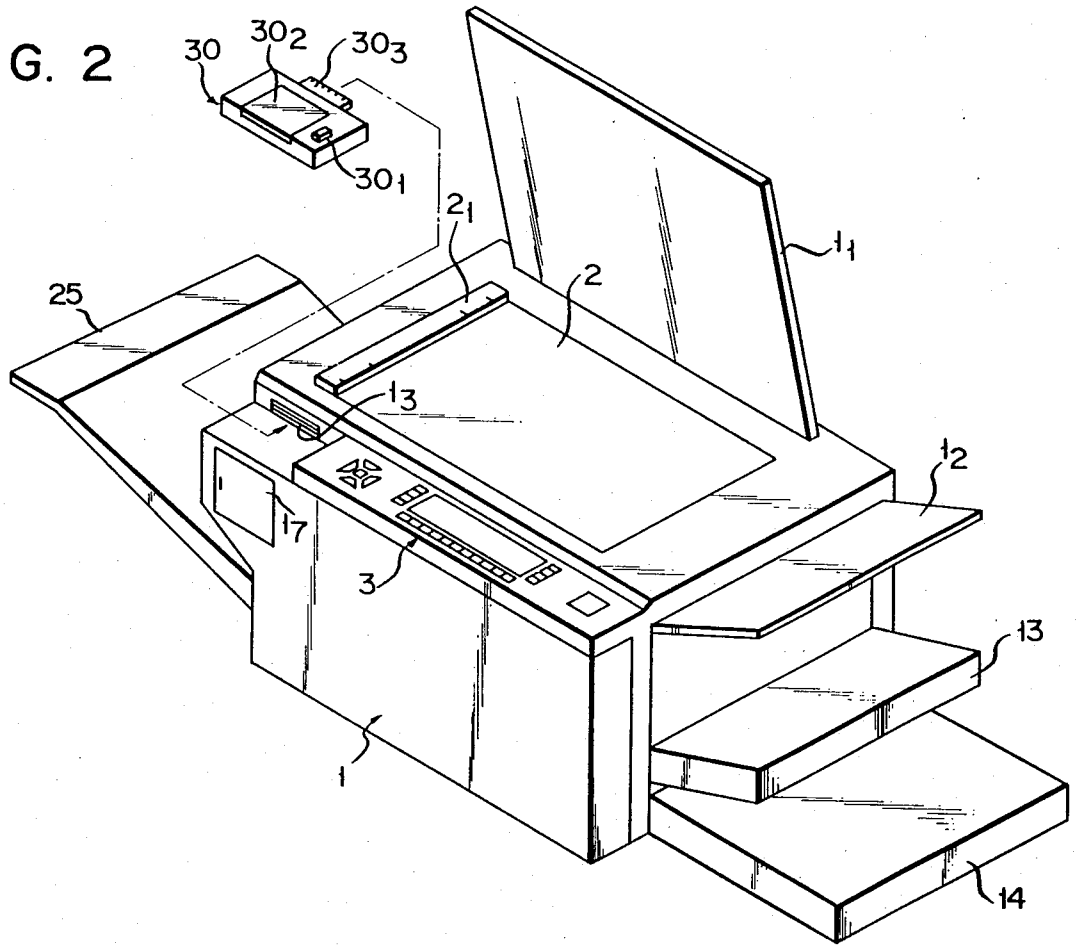
Figure 3:
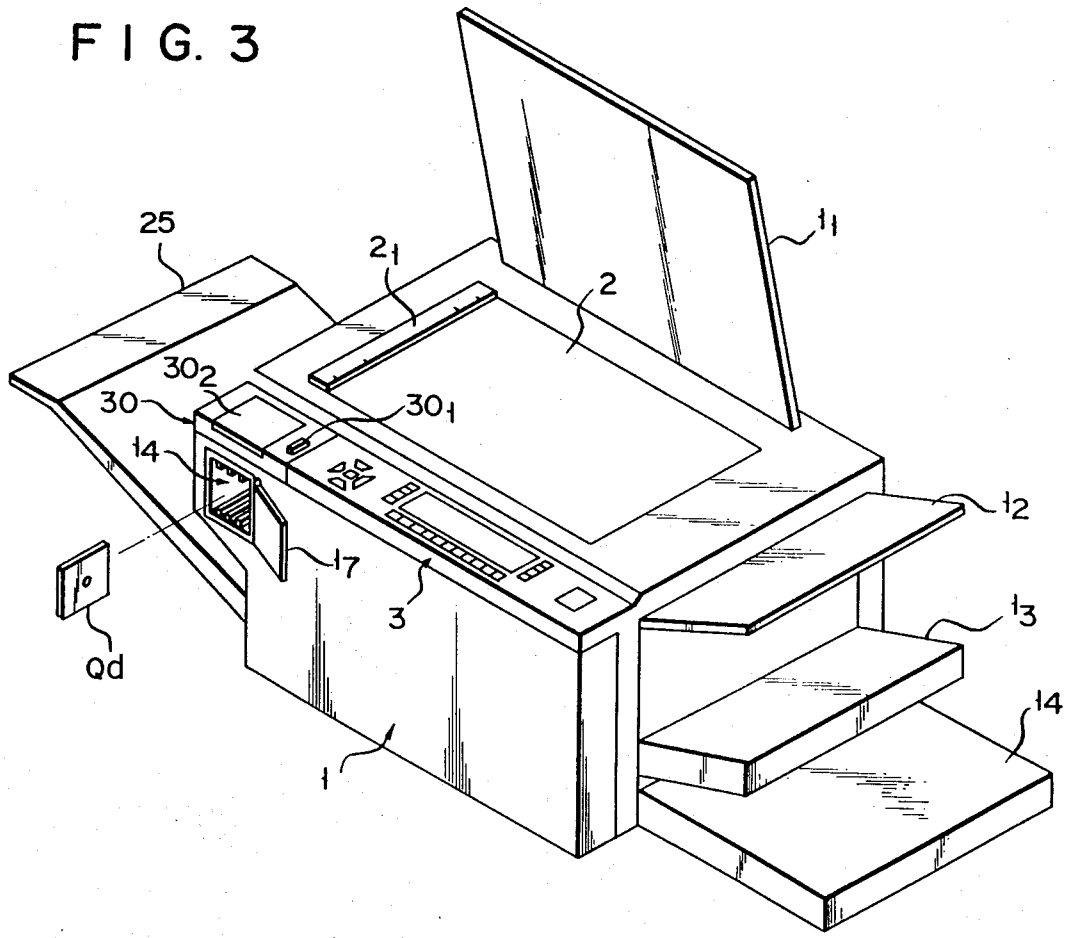

FIGS. 1 to 3 schematically show an image forming apparatus, e.g., a copying machine, of the present invention. Reference numeral 1 denotes a copying machine housing. Original table (i.e., transparent glass) 2 is fixed on the upper surface of housing 1. Fixed scale $2_1$ as a reference for placing an original is arranged on table 2, and openable original cover $1_1$ and work table $1_2$ are arranged adjacent to table 2. Control panel 3 is arranged on the upper surface of housing 1, and has so-called quick disk device 30 comprising a disk drive mechanism. The quick disk device is a simple type of floppy disk and is distinguished from an ordinary floppy disk in that data stored thereon can be simply read out in a given sequence, not at random. In device 30, when eject button $30_1$ is depressed, cover $30_2$ is opened, as indicated by a dotted line in FIG. 1. In this state, quick disk Qd, comprising a rotatable magnetic recording medium, can be put into and taken out of device 30.

Device 30 is detachably mounted on housing 1, as shown in FIG. 2. More specifically, connection terminal $30_3$ projects from a side surface of device 30, and can be connected and disconnected to and from insertion hole $1_3$ formed in housing 1. When terminal $30_3$ is inserted in hole $1_3$, it is connected to a connection section (not shown) provided in housing 1.

Figure 4:
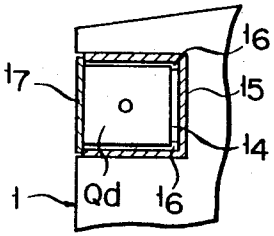

Container section $1_4$ for quick disk Qd is formed in the front surface of housing 1, as shown in FIG. 3. The interior of section $1_4$ comprises metal sealed case $1_5$, and holding member $1_6$ for vertically supporting disks Qd is provided in case $1_5$, as shown in FIG. 4. Openable cover $1_7$ covering section $1_4$ is arranged at the front surface of housing 1.

As will be described later, quick disk Qd stores display data specifying each operation of the copying machine, control data for controlling the operation thereof, and the like.

Figure 5:
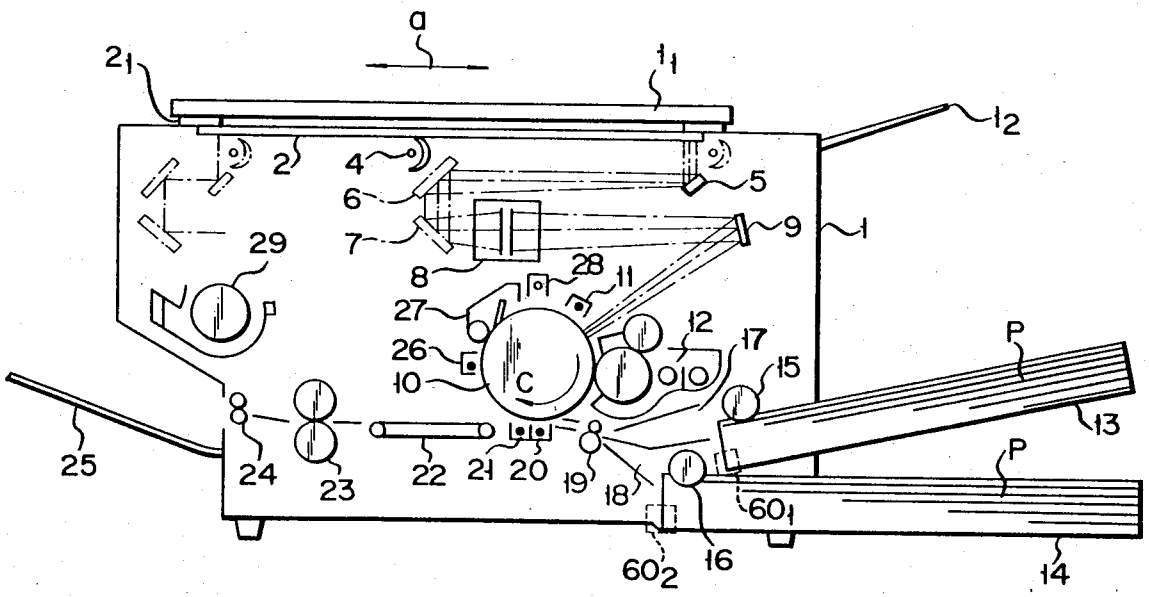

On the other hand, as shown in FIG. 5, the original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by a developing unit 12 using toner. Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches $60_1$ and $60_2$ which detect the selected cassette size. The detecting switches $60_1$ and $60_2$ are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by an exit roller pair 24.

After the transfer, moreover, the photosensitive drum 10 is de-electrified by a de-electrification charger 26, whereby the residual toner on the surface of the drum 10 is removed by a cleaner 27. Thereafter, a residual image on the photosensitive drum 10 is erased by a discharge lamp 28 to restore the initial state. In FIG. 5, numeral 29 designates a cooling fan for preventing the temperature inside the housing 1 from rising.

Figure 6:
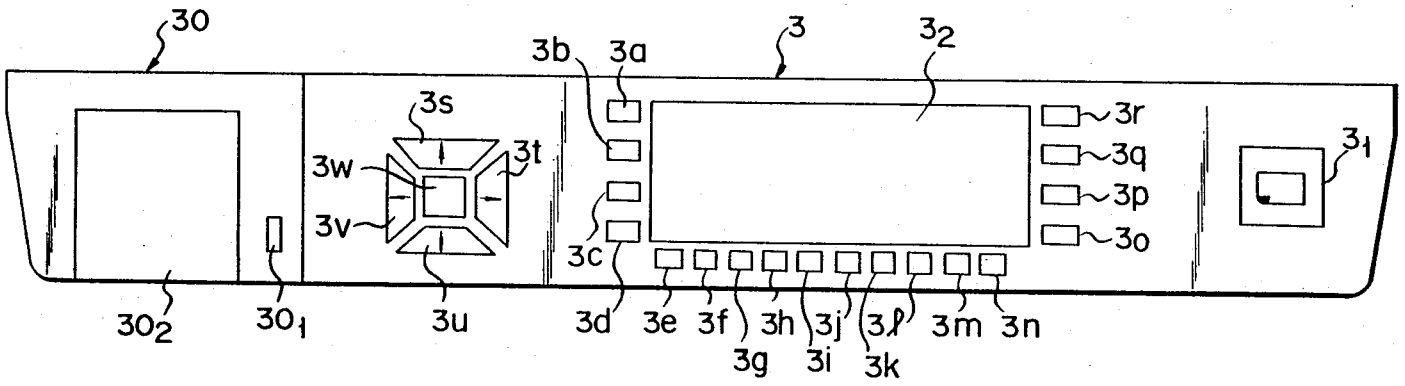

FIG. 6 shows control panel 3 mounted on housing 1. Reference numeral $3_1$ denotes a copy key for starting the copying operation; and $3_2$, a display section comprising a liquid crystal dot matrix display. Section $3_2$ selectively displays display data stored in quick disk Qd in accordance with respective modes. A plurality of operation members or setting keys 3*a* to 3*r* for setting different copying functions are provided to surround section $3_2$, including ten keys for setting the copying number, a magnification setting key for setting a copying magnification, cassette selection keys for selecting upper and lower paper feed cassettes 13 and 14, and the like, to be described later. Furthermore, operation keys 3*s* to 3*v* for driving spot light source 131 (to be described later) and position specifying key 3*w* for specifying a coordinate position of an original are arranged on panel 3.

Figure 7:
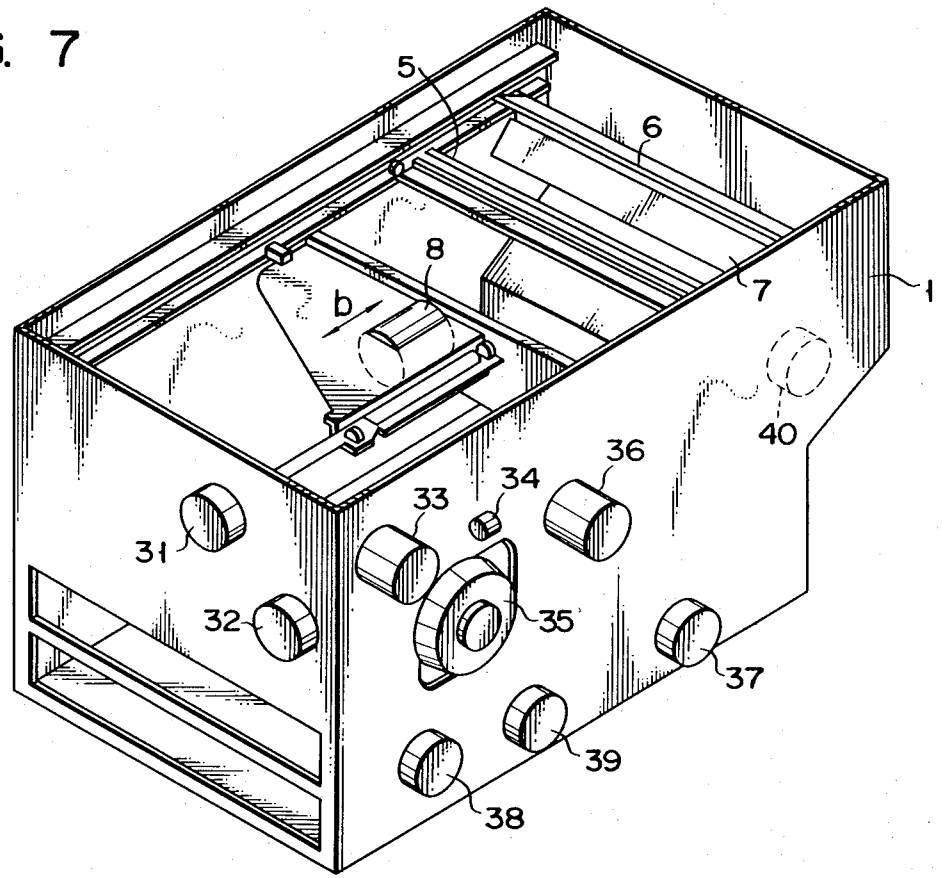

FIG. 7 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the paper-supply rollers 15 and 16. Numeral 39 designates a motor for feeding sheets. The sheet feed motor 39 serves to drive the aligning roller pair 19. Numeral 40 designates a motor for fan drive. The fan drive motor 40 serves to drive the cooling fan 29.

Figure 8:
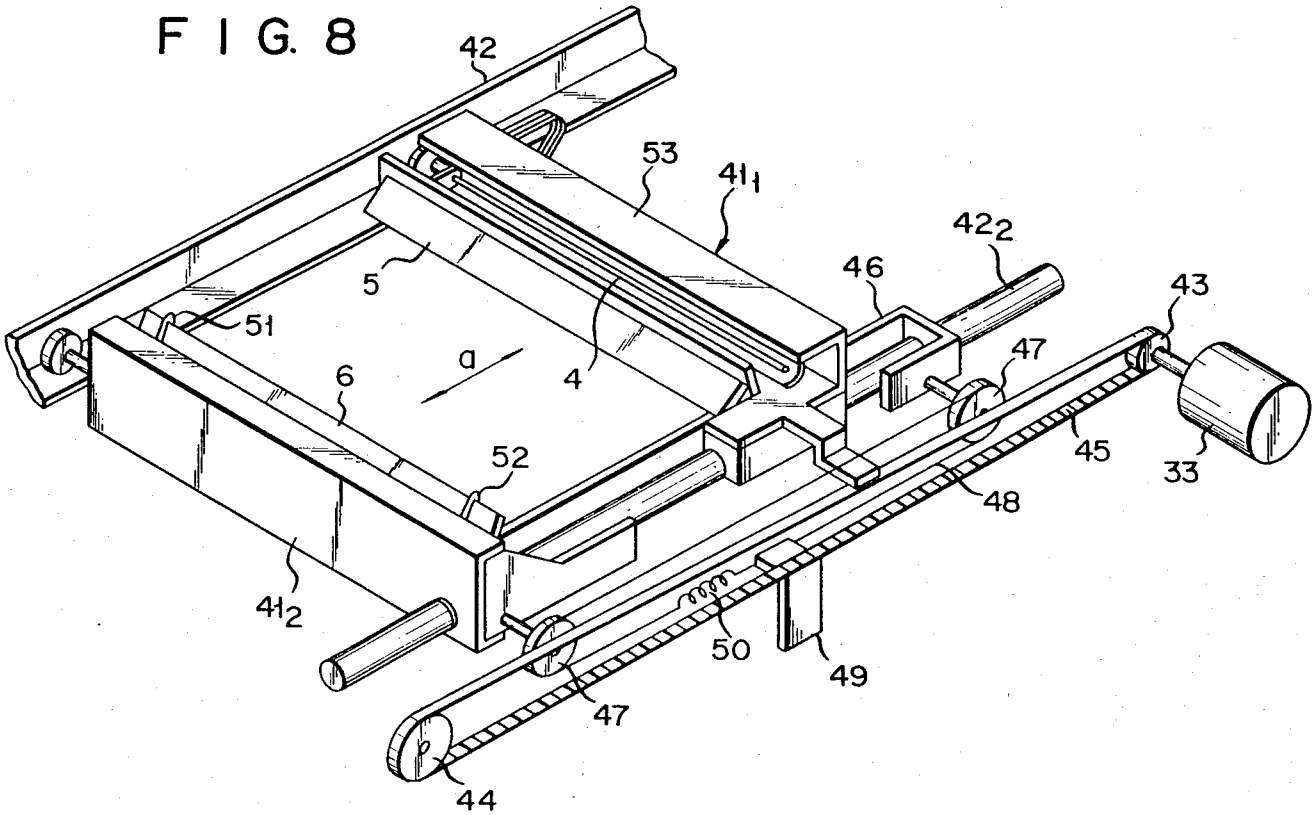

FIG. 8 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase stepping motor 33 drives a pulley 43. An endless belt 45 is stretched between the pulley 43 and an idle pulley 44, and one end of the first carriage $41_1$ supporting the mirror 5 is fixed to the middle portion of the belt 45.

On the other hand, two pulleys 47 are rotatably attached to a guide portion 46 (for the rail $42_2$) of the second carriage $41_2$ supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage $41_1$ is fixed to the middle portion of the wire 48.

With this arrangement, when the stepping motor 33 is driven, the belt 45 turns around to move the first carriage $41_1$. As the first carriage $41_1$ travels, the second carriage $41_2$ also travelss. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the stepping motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $$x = Px/K,$$

$$y = Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 9:
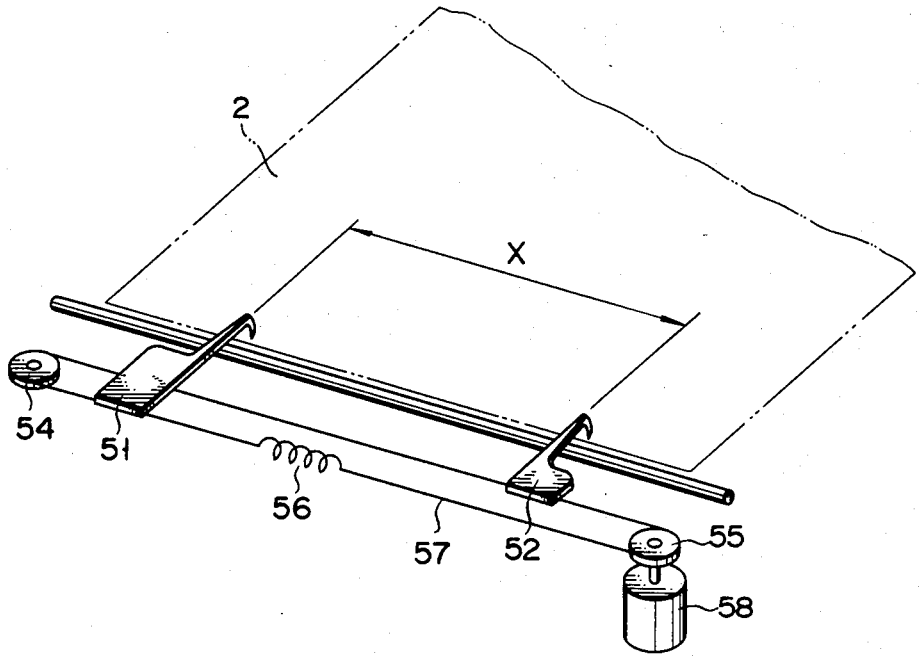

As shown in FIG. 9, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, lamp 4 is lighted and the first carriage $41_1$ is moved away from the second carriage $41_2$. When the original scanning ends, the lamp 4 is turned off, and the first carriage $41_1$ is returned to the home position.

Figure 10:
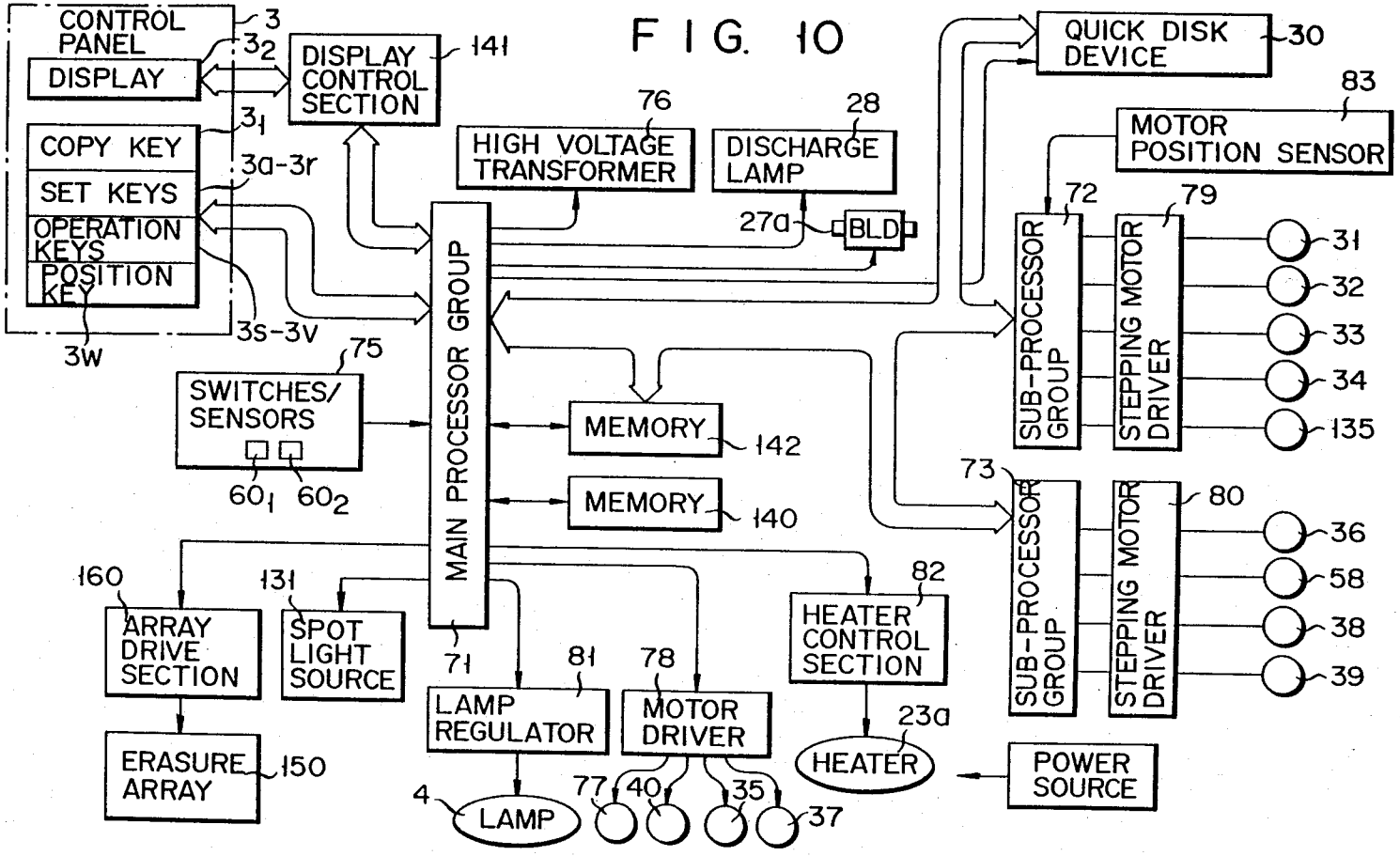

FIG. 10 shows a general control circuit of the electronic copying machine. This control circuit is mainly composed of a main processor group 71 and first and second sub-processor groups 72 and 73. The main processor group 71 detects input data from the control panel 3 and a group of input devices 75 including various switches and sensors, such as the cassette size detection switches $60_1$ and $60_2$ and controls a high-voltage transformer 76 for driving the chargers, the discharge lamp 28, a blade solenoid 27*a* of the cleaner 27, a heater 23*a* of the fixing roller pair 23, the exposure lamp 4, and the motors 31 to 40 and 58, thus accomplishing the copying operation. The main processor group 71 also controls a spot light source 131, a stepping motor 135, an erasure array 150, an array drive section 160, and a memory 140, thereby erasing any unnecessary portions of the original. These components 131, 135, 150, 160 and 140 will be described in detail later.

Further, the main processor group 71 controls device 30, memory 142, and display control device 141 so as to control display section $3_2$.

The motors 35, 37 and 40 and a toner-supply motor 77 for supplying the toner to the developing unit 12 are connected through a motor driver 78 to the main processor group 71 to be controlled thereby. The motors 31 to 34 and 135 are connected through a stepping motor driver 79 to the first subprocessor group 72 to be controlled thereby. The motors 36, 38, 39 and 58 are connected through a stepping motor driver 80 to the second subprocessor group 73 to be controlled thereby.

Further, the exposure lamp 4 is controlled by the main processor group 71 through a lamp regulator 81, and the heater 23*a* by the main processor group 71 through a heater control section 82. The main processor group 71 gives instructions for the start or stop of the individual motors to the first and second sub-processor groups 72 and 73. Thereupon, the first and second subprocessor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34.

Figure 11:
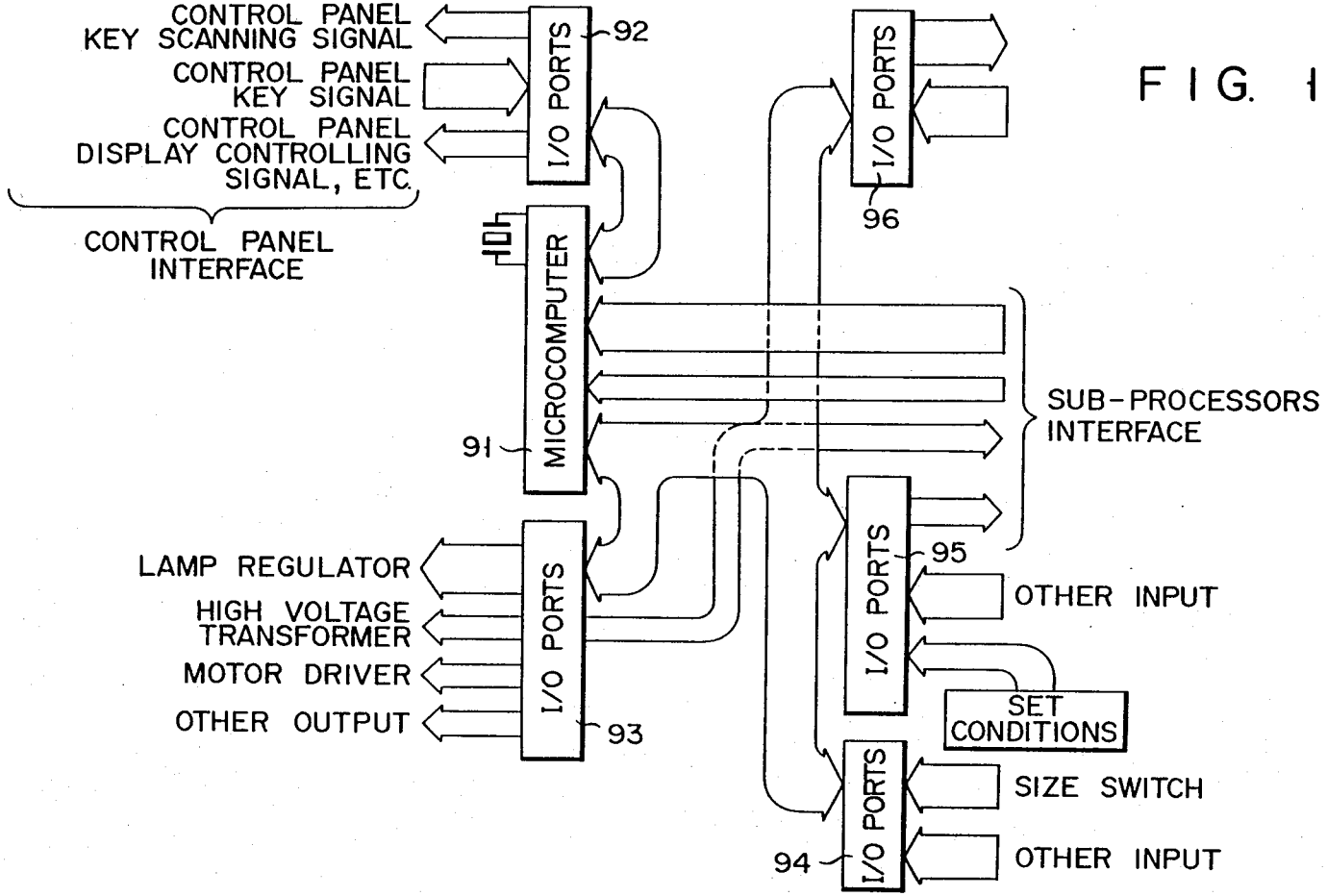

FIG. 11 shows an arrangement of the main processor group 71. Reference numeral 91 denotes a one-chip microcomputer (to be referred to as a CPU hereinafter). The CPU 91 detects key inputs at a control panel (not shown) through an I/O port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 12:
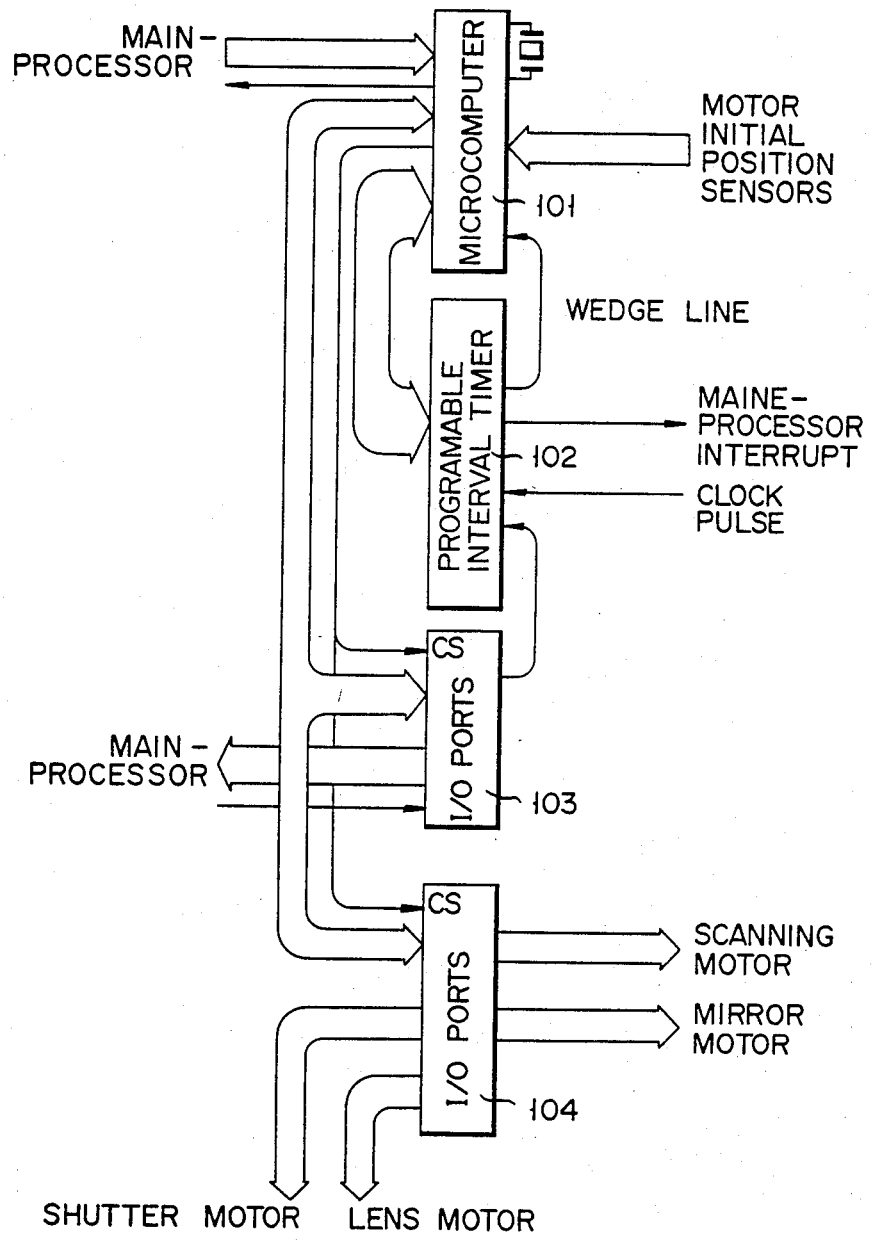

FIG. 12 shows an arrangement of the first subprocessor group 72. Reference numeral 101 denotes a CPU connected to the group 71. Reference numeral 102 denotes a programable interval timer for controlling switching time intervals. A preset value from the CPU 101 is set in the programable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34 and 135 through the stepping motor driver 79. The port 103 is used to supply a status signal from each stepping motor to the group 71.

Figure 13:
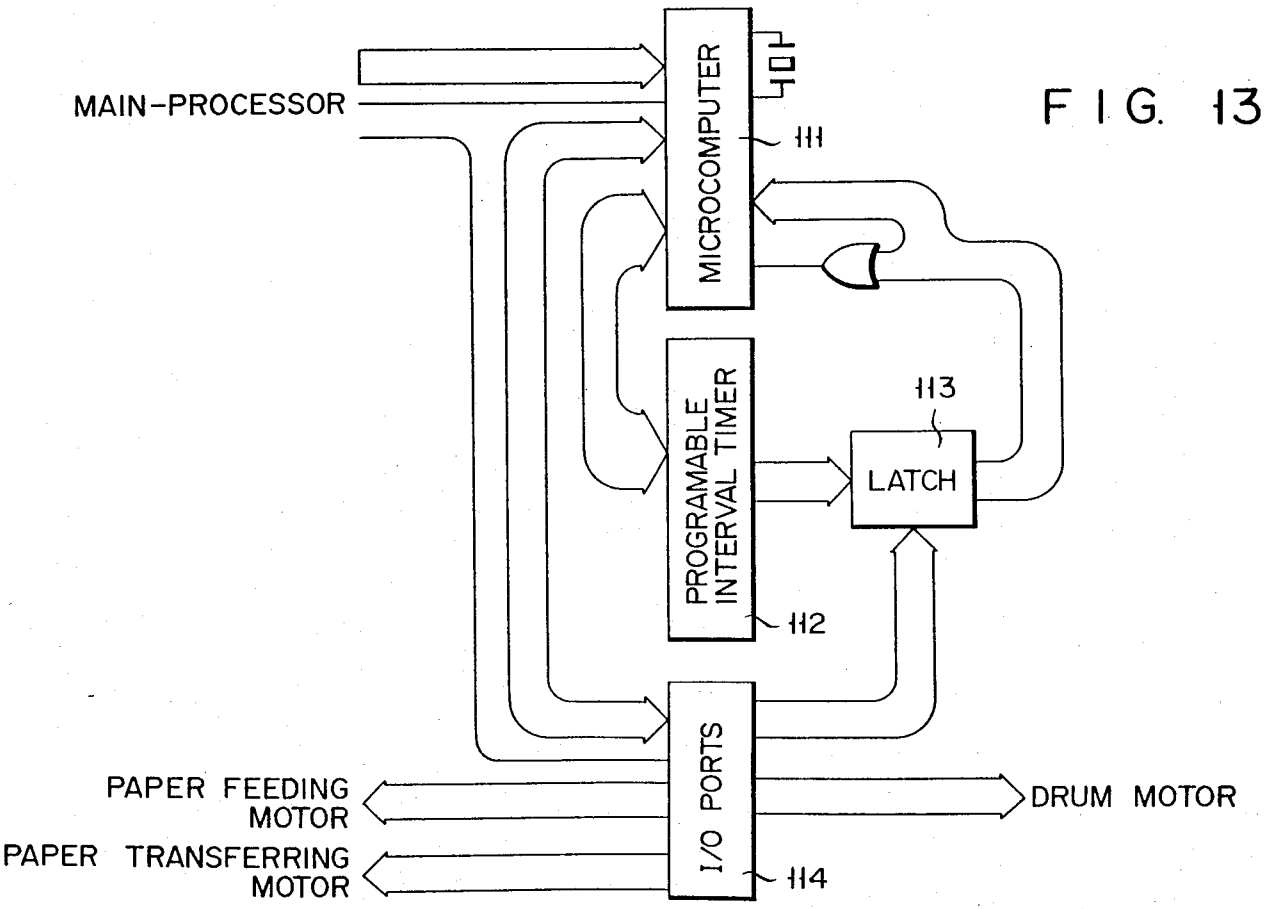

FIG. 13 shows an arrangement of the second subprocessor group 73. Reference numeral 111 denotes a CPU connected to the group 71. Reference numeral 112 denotes a programable interval timer for controlling switching time intervals of the pulse motors. A preset value from the CPU 111 is set in the programable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

FIG. 14 shows a stepping motor control circuit. An I/O port 121 (corresponding to the ports 104 and 114 of FIGS. 12 and 13) is connected to a stepping motor driver 122 (corresponding to the drivers 79 and 80 of FIG. 10). The driver 122 is connected to windings A, $\overline{A}$, B and $\overline{B}$ of a stepping motor 123 (corresponding to the motors 31 to 34, 36, 38 and 39).

FIGS. 15A and 15B show a method of controlling a stepping motor speed. FIG. 15A shows a stepping motor speed curve, and FIG. 15B shows switching intervals. As is apparent from FIGS. 15A and 15B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Indicating means and erasing means according to the present invention will now be described in detail.

Figure 16:
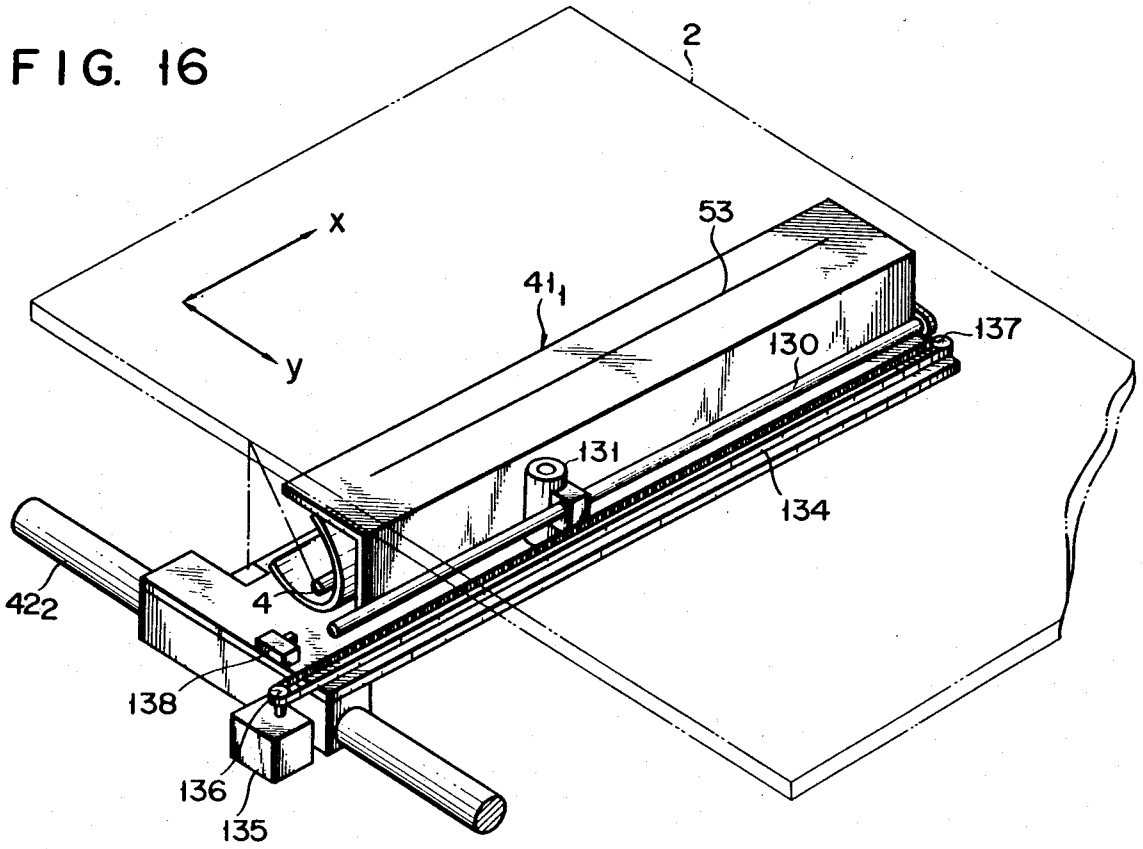
Figure 17:
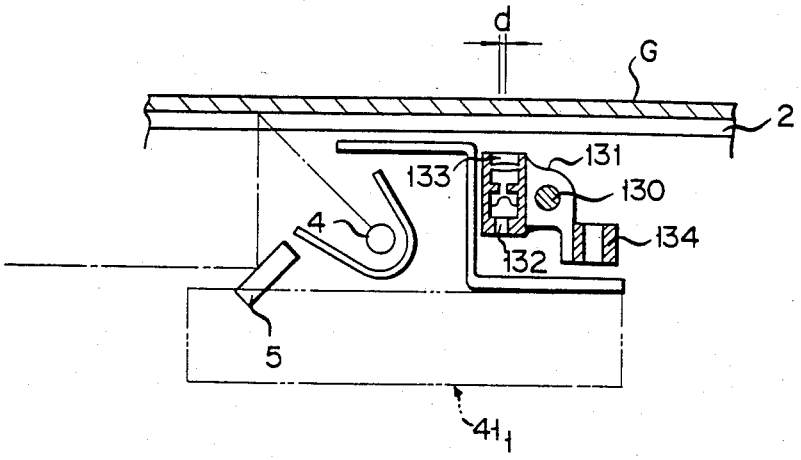

In FIGS. 16 and 17, a guide shaft 130 is disposed at that portion of the first carriage $41_1$ intercepting the light from the lamp 4, extending along the lamp 4. The guide shaft 130 is movably fitted with the spot light source 131 as the indicating means for indicating an erasure range of the original. As shown in FIG. 17, the spot light source 131 includes a light emitting element 132, such as a light emitting diode or lamp, and a lens 133 which are opposed to the original table 2.

A light beam emitted from the light emitting element 132 is applied to the original table 2 through the lens 133, as a spot light with a diameter d of, e.g., 2 mm. The spot light has enough brightness to be transmitted through an original G as thick as, e.g., a postcard set on the original table 2. The spot light source 131 is coupled to a timing belt (toothed belt) 134 extending along the guide shaft 130. The timing belt 134 is stretched between a pulley 136 mounted on the shaft of the stepping motor 135 and a driven pulley 137. As the stepping motor 135 is rotated the spot light source 131 is moved in a direction perpendicular to the scanning direction of the first carriage $41_1$.

A position sensor 138 formed of a microswitch for detecting the initial position of the spot light source 131 is attached to that portion of the first carriage $41_1$ which is located beside the end portion of the guide shaft 130 on the side of the stepping motor 135. When the spot light source 131 is moved, for example, it first abuts against the position sensor 138 to have its initial position detected thereby.

Figure 18:
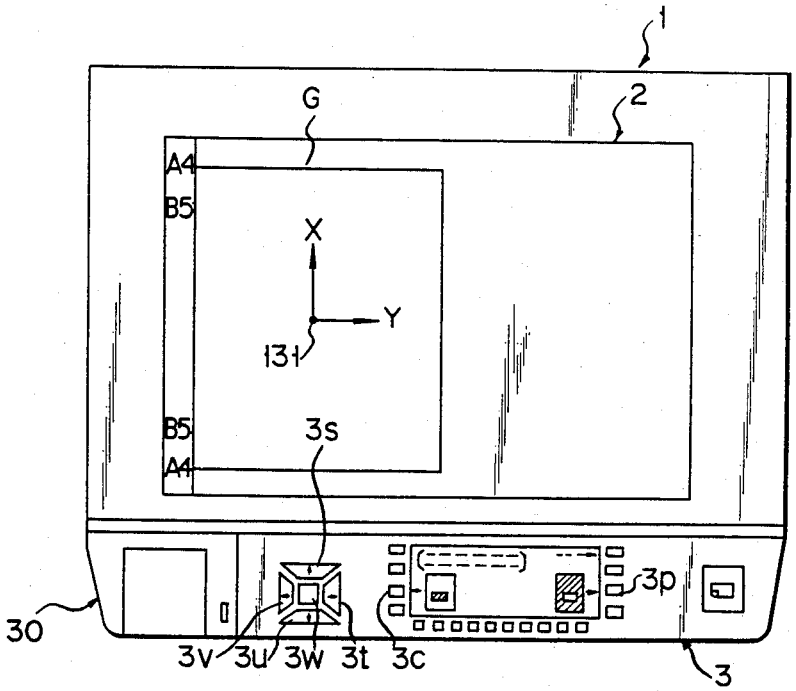

Referring now to FIGS. 18 to 20, there will be described a method for designating the erasure range of the original by means of the spot light source 131.

The spot light source 131 is moved by operating the operation keys 30*s* to 30*v* in an erasure area display mode to be described later. When the operation keys 30*t* and 30*v* are depressed, the motor 33 is started, and the first carriage $41_1$ and the spot light source 131 are moved in the scanning direction (indicated by arrow y in FIG. 18). When the operation keys 30*s* and 30*u* are depressed, on the other hand, the motor 135 is started, and the spot light source 131 is moved in a direction (indicated by arrow x in FIG. 18) perpendicular to the scanning direction.

Figure 19A:
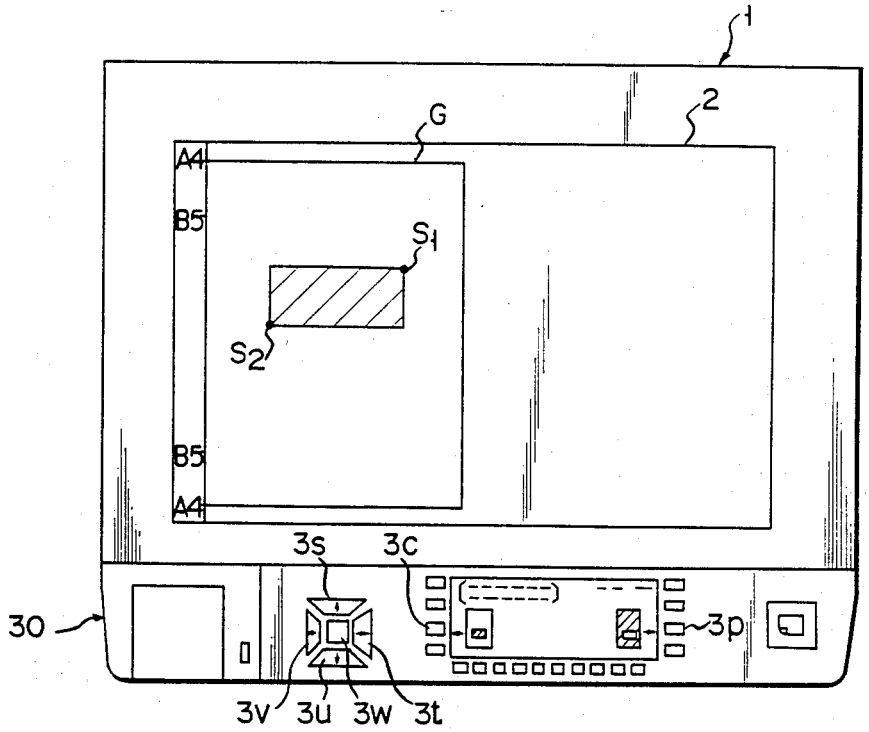

Observing the spot light transmitted through the original G, the operator operates the operation keys 30*s* to 30*v*. When the spot light reaches, for example, a spot S1 on the original G shown in FIG. 19A, the operator depresses the position designating key 30*w*. Thereupon, the coordinate position indicated by the spot S1 is stored in the main processor group 71 shown in FIG. 10. Likewise, if the position designating key 30*w* is depressed when a spot S2 on the original G is reached by the spot light, the position of the spot S2 is stored in the main processor group 71. This position of the spot light can be detected by, for example, counting drive pulses delivered from the stepping motors 33 and 135. When the erasure range designating key 30*c* which is set shown in FIG. 28F, is depressed thereafter, a rectangular region (hatched region) having its two opposite vertexes on the spots S1 and S2 is designated as the erasure range, as shown in FIG. 19A.

Figure 19B:
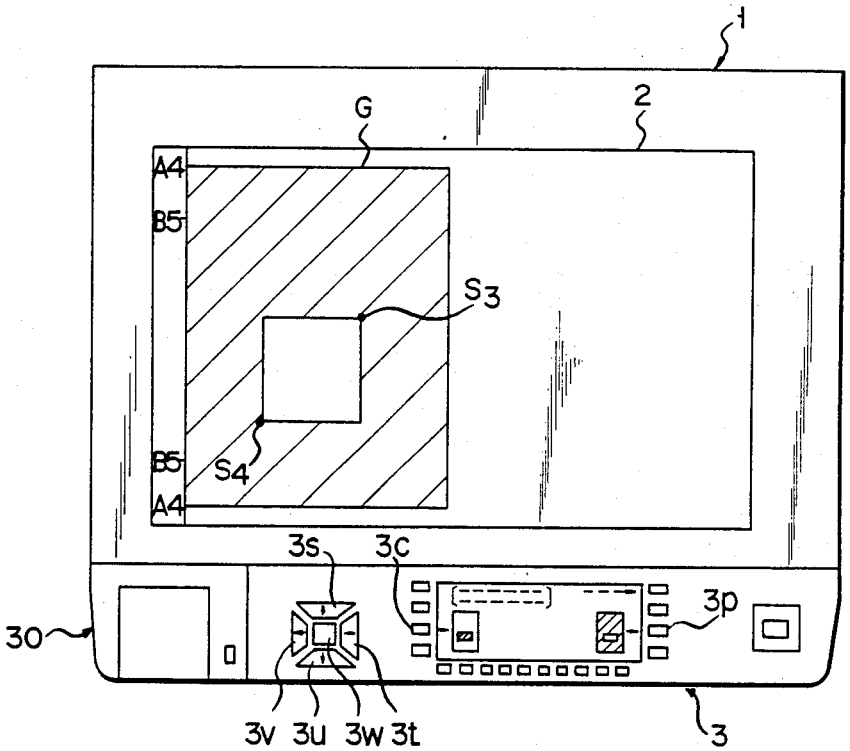
Figure 28A:
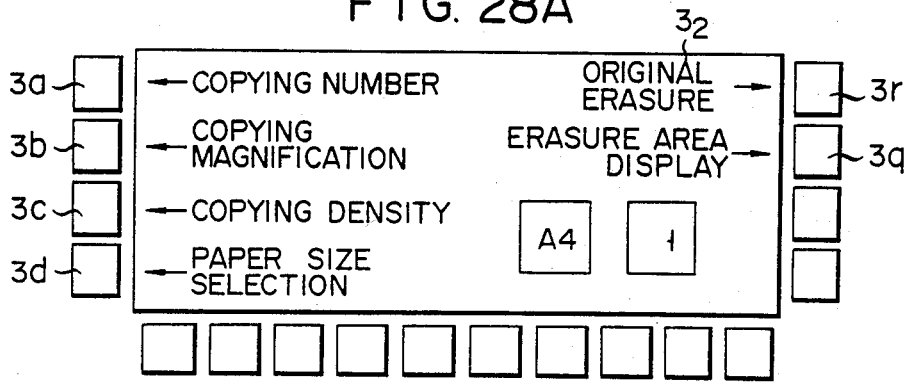
FIGS. 28A to 28O are illustrations for explaining the operation of a display section.
Figure 28B:
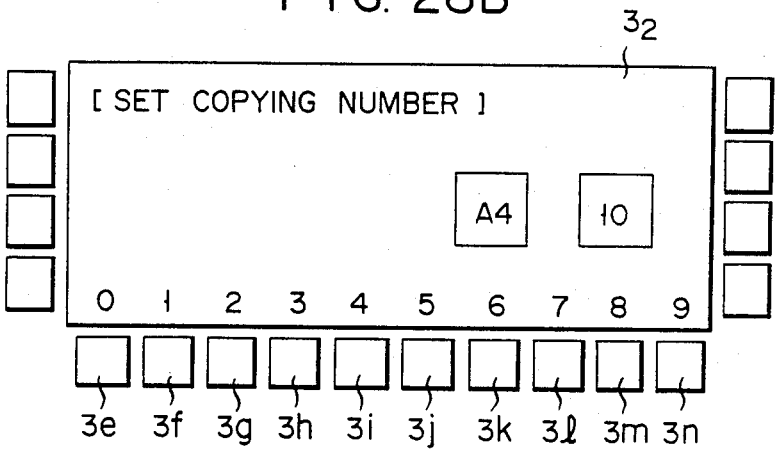
Figure 28C:
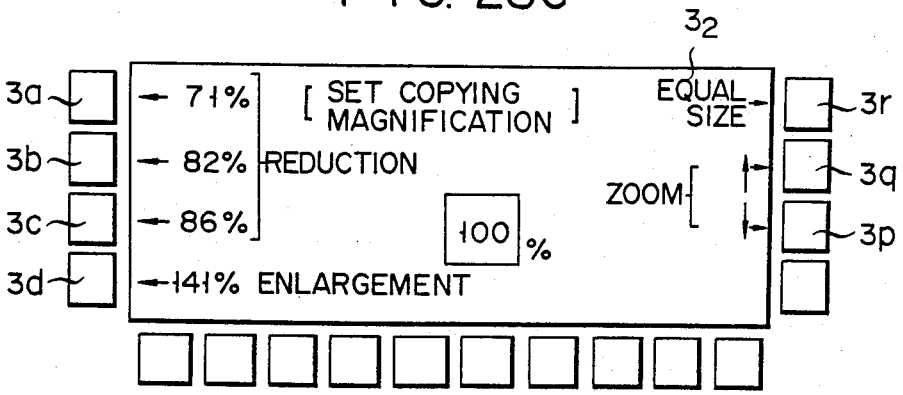
Figure 28D:
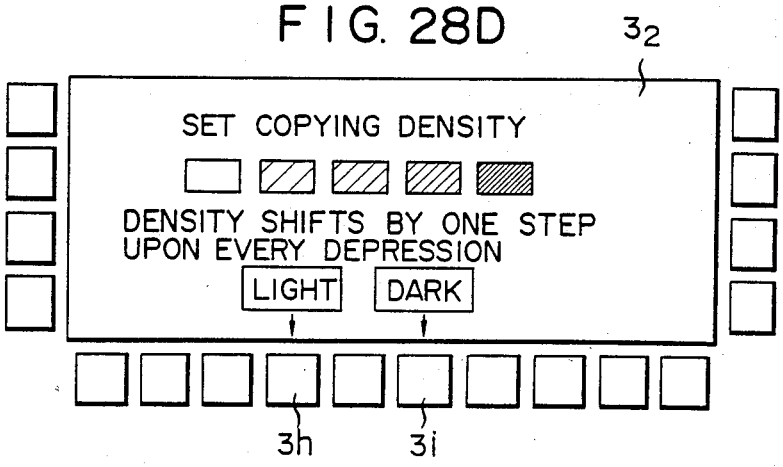
Figure 28E:
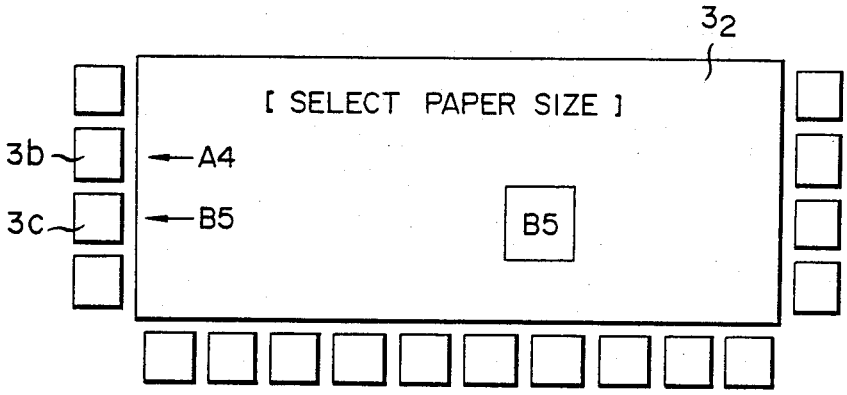
Figure 28F:
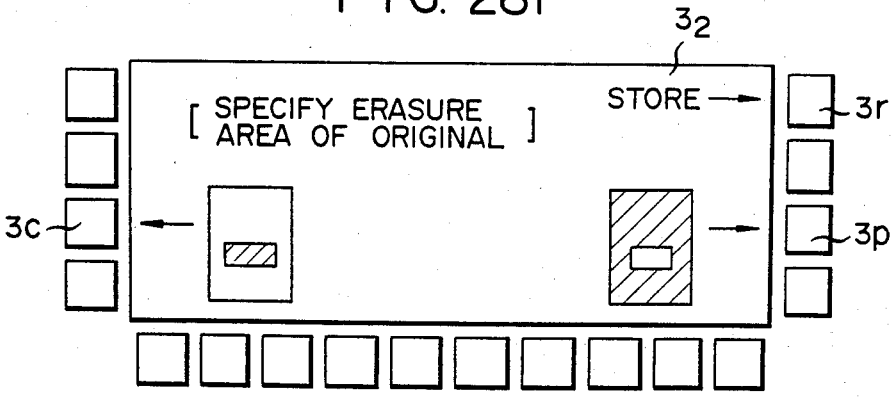

If the erasure range designating key 30*p* which is set shown in FIG. 28F, is depressed after designating spots S3 and S4 on the original G, the other region of the original G (i.e. not a square region having its two opposite vertexes on the spots S3 and S4) is designated as the erasure range, as shown in FIG. 19B.

Figure 20A:
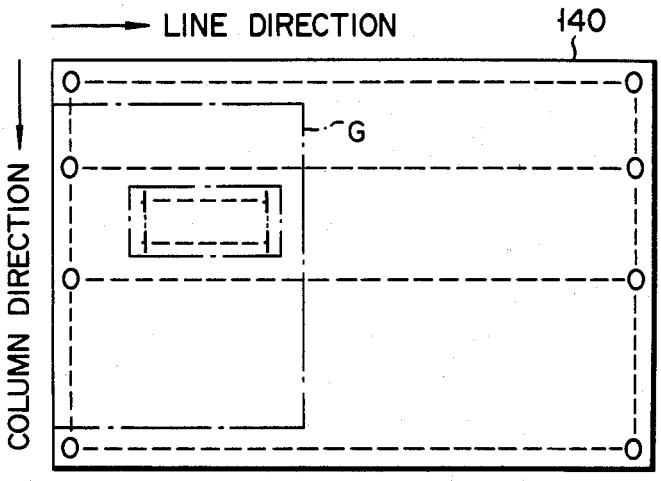
FIGS. 20A and 20B are illustrations for explaining memory content.
Figure 20B:
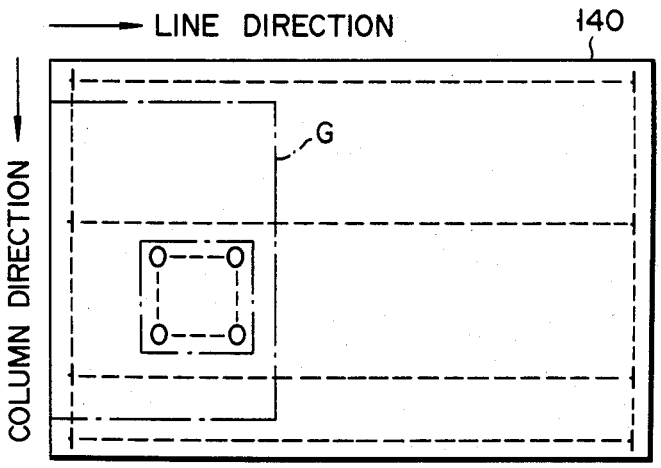

Thus, if the key 30*c* or 30*p* is depressed, the group 71 performs arithmetic operation in accordance with the specified two positions. Position data of the erasure area are set at logic "1" and position data of an area excluding the erasure area are set at logic "0". These position data are stored in the memory 140. A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution thereof along the y direction). The memory 140 comprises a RAM having the memory capacity described above. In the cases of FIGS. 19A and 19B, high level signals are stored at addresses corresponding to the hatched area and low level signals are stored at other addresses in response to the data supplied from the group 71, as shown in FIGS. 20A and 20B, respectively.

In this case, the original is placed on table 2 so that the copying surface faces upward, and is turned over and aligned along scale $2_1$ of table 2 after the erasure area specifying operation is completed. Therefore, data stored in memory 140 (shown in FIG. 20) is inverted in the column direction.

Figure 21A:
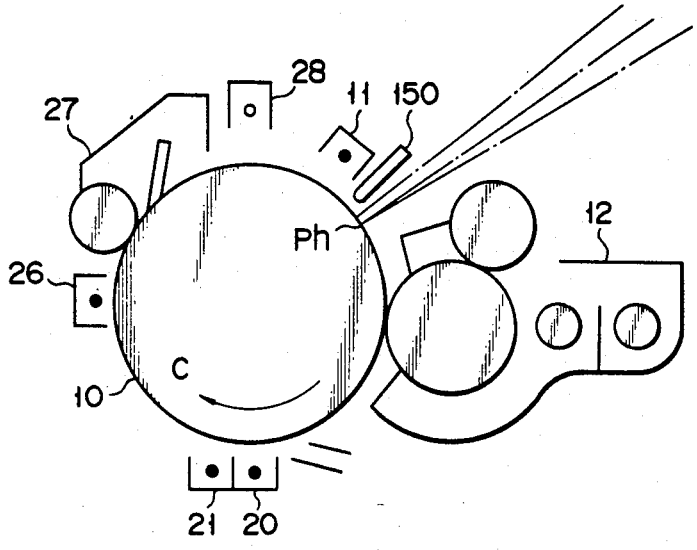
FIGS. 21A and 21B are side sectional views showing different arrangements of an erasure array.
Figure 22:
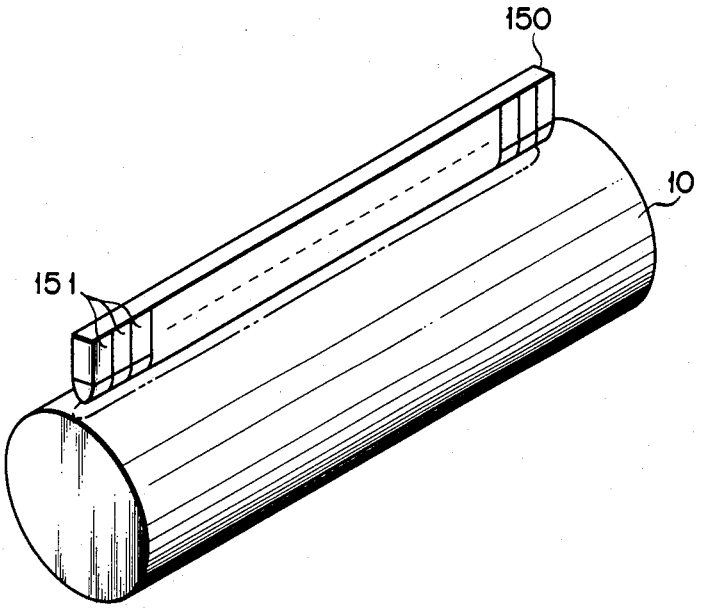
Figure 23:
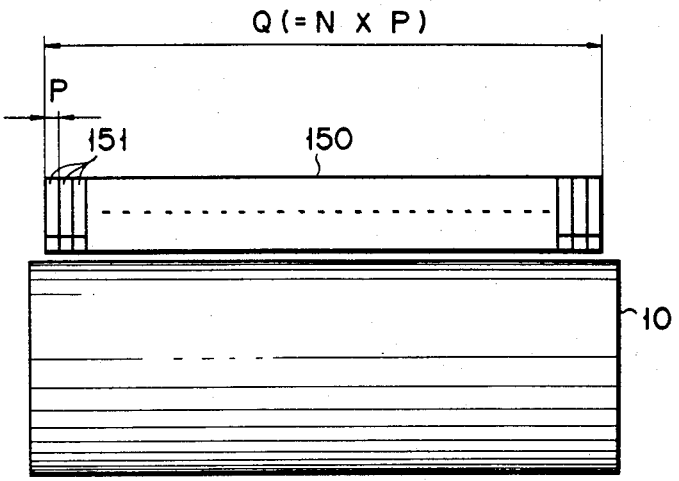
Figure 24A:
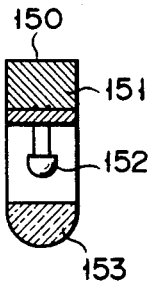
FIGS. 24A and 24B are a side sectional view and a partially cutaway view showing an arrangement of the erasure array.
Figure 24B:
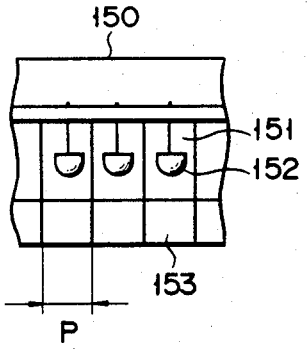

As shown in FIG. 21A, on the other hand, the erasure array 150 as the erasing means is disposed close to the photosensitive drum 10, between the charger 11 and an exposure region Ph, for example. As shown in FIGS. 22 and 23, the erasure array 150 includes a plurality of shading cells 151 which are arranged in a direction perpendicular to the rotating direction of the photosensitive drum 10. As shown in FIGS. 24A and 24B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light-emitting elements arranged in erasure array 150 corresponds to the same as the column capacity of memory 140. When the distance between light-emitting elements 152 is given by P and the number of elements is given by N, overall length Q of array 150 is given by $Q=N\cdot P$.

Figure 25:
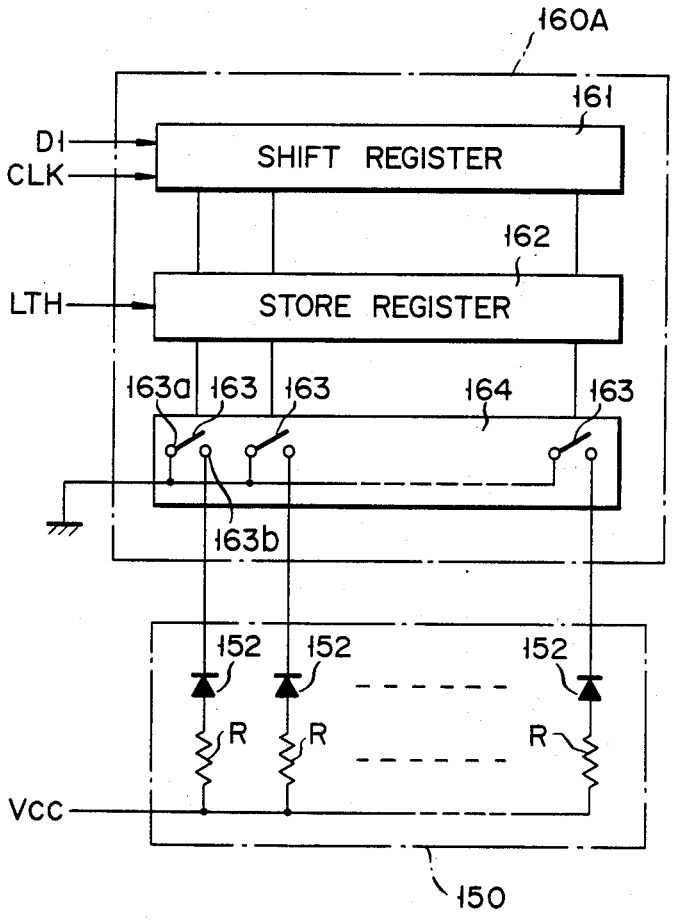

The array 150 is driven by an array drive section 160. As shown in FIG. 25, the section 160 comprises a shift register 161 having the same bit number as the rank bit number of the memory 140, a store register 162 for storing the content of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

After the erasure area of the unnecessary portion of the original is specified, the operator closes the original cover $1_1$ and depresses the key $30_1$. The carriage $41_1$ and drum 10 are driven, and one-rank data are sequentially read out along the line direction (FIGS. 20 and 21) of the memory 140. The readout data D1 are transferred to the register 161 in the section 160 in response to the clock signal CLK. After one-rank data is transferred to the register 161 and the charged portion of the drum 10 reaches the array 150, the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-rank data is transferred from the memory 140 to the register 162 prior to $\theta 1/\omega$ where $\theta 1$ is the angle between the array 150 and the portion Ph and $\omega$ is the peripheral velocity of the drum 10.

The elements 163 in the circuit 164 are controlled in response to the output signal from the register 162. When the output of the register 162 is set at high level, the elements 163 are turned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank is erased. The data is thus read out from the memory 140 in units of ranks, thereby erasing the unnecessary image portion.

The operation of respective portions of the apparatus, including display section $3_2$, when quick disk device 30 is used will now be described.

Figure 26A:
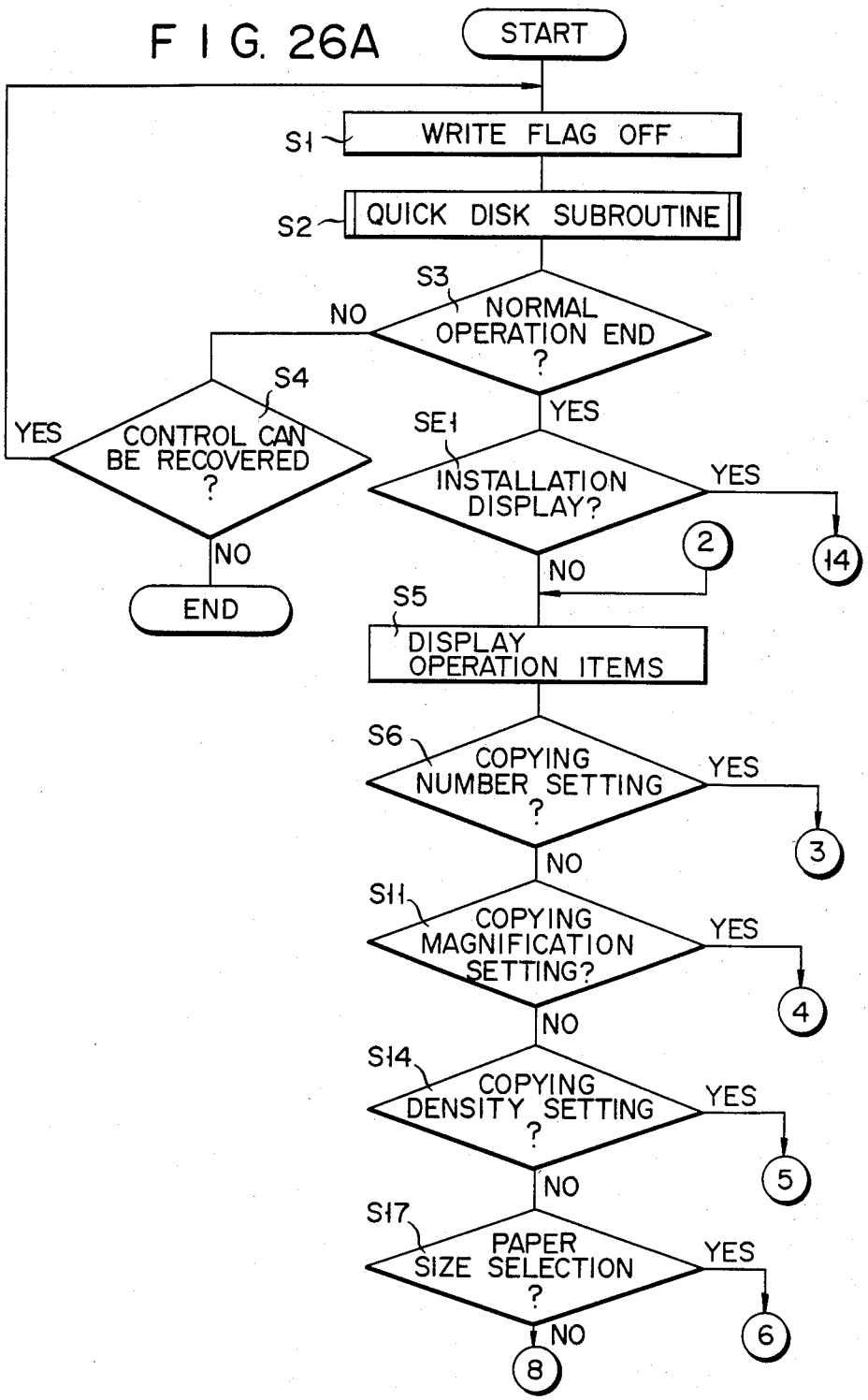

As shown in FIG. 26A, when power of housing 1 is turned on, main processor group 71 turns off a write flag in step S1 and the control flow enters a quick disk subroutine in step S2. In the quick disk subroutine shown in FIG. 27A, it is checked in step SQ1 if a quick disk set signal generated from device 30 is at low level "L", thus discriminating whether or not quick disk Qd is set in device 30. If NO in step SQ1, a message "set quick disk" stored in group 71 in advance is supplied to section $3_2$ through display control section 141, and is displayed in step SQ2. It is checked in step SQ3 if a preset time (e.g., 30 seconds) has elapsed. If NO in step SQ3, the flow returns to step SQ1. Otherwise, an abnormality end code (return code) indicating a no-disk state is set in step SQ4, and the control flow shifts to step S3 shown in FIG. 26A.

Figures 1, 27A:
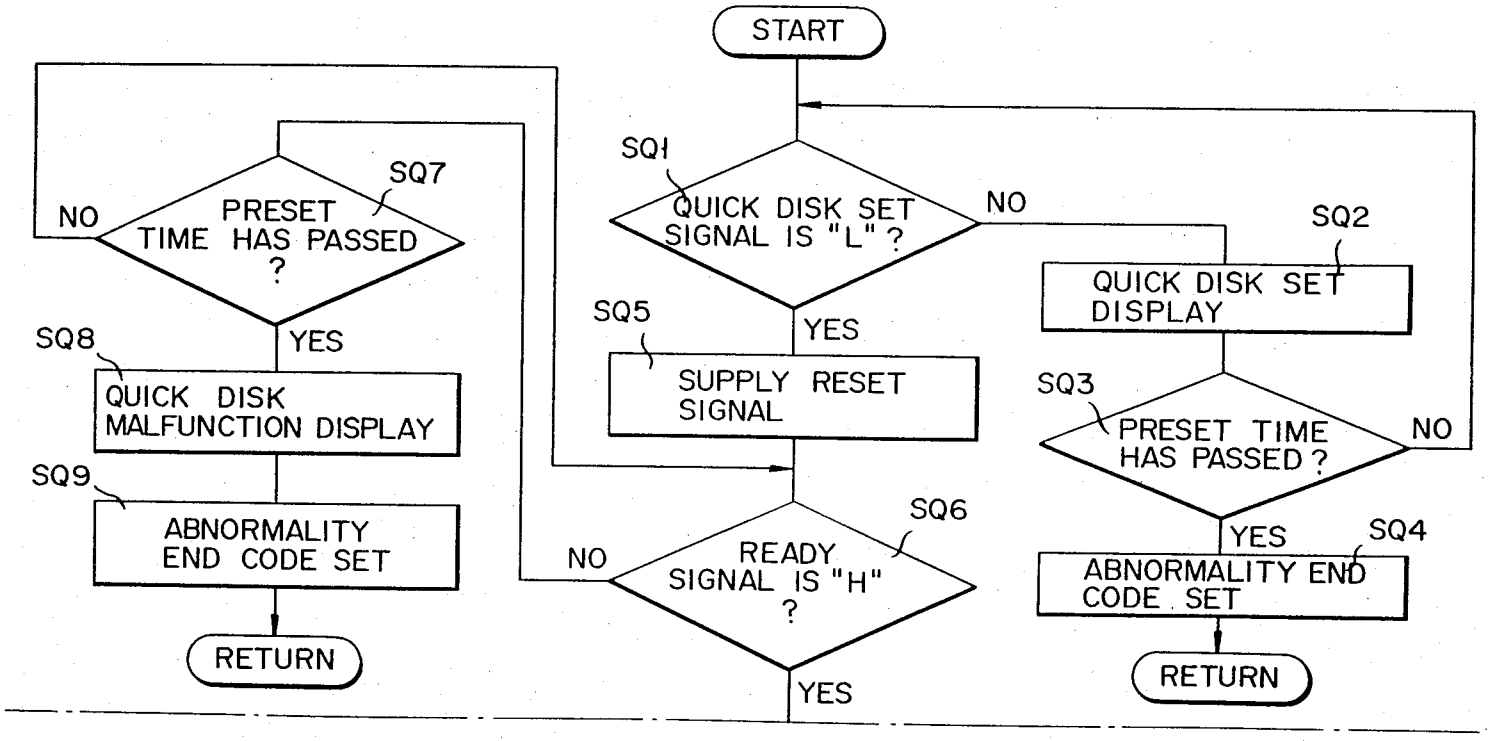
Figures 2, 27A:
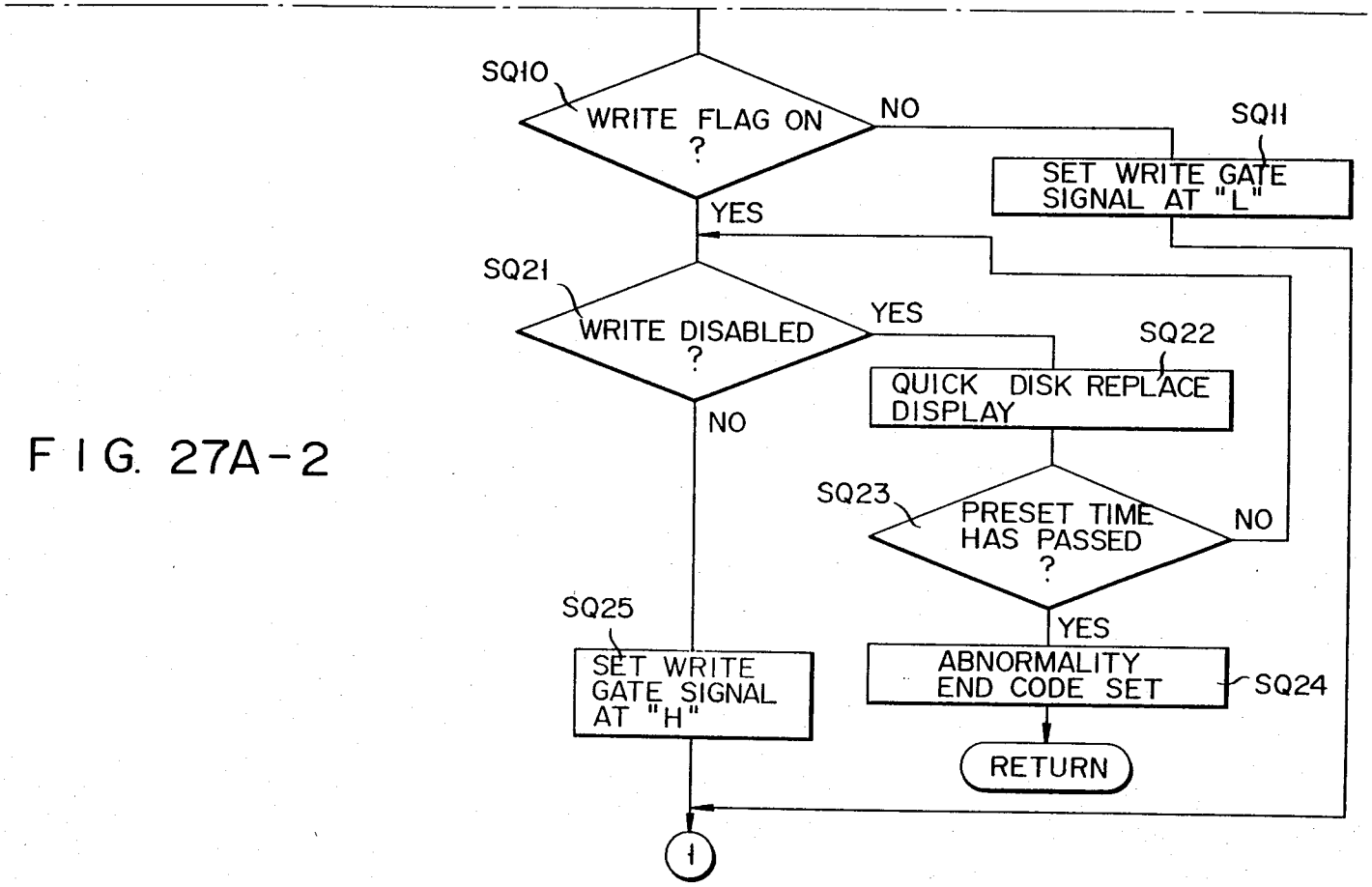

If step SQ1 is yes, however, a reset signal is supplied to device 30 in step SQ5 as shown in FIG. 27A. Upon reception of the reset signal, device 30 resets a motor control flip-flop circuit (not shown) so as not to start a motor (not shown) as a disk drive mechanism. After the initial state of device 30 is set, device 30 generates an "H"-level ready signal which is detected in step SQ6. If NO in step SQ6, it is checked in step SQ7 if a preset time (e.g., 2 seconds) has passed. If NO in step SQ7, the flow returns to step SQ6. If YES in step SQ7, the flow advances to step SQ8, and a message "quick disk device malfunction" stored in group 71 is supplied to section $3_2$ through section 141 and is displayed. In step SQ9, a return code indicating the malfunction of device 30 is set, and the control flow shifts to step S3 in FIG. 26A.

Figure 27B:
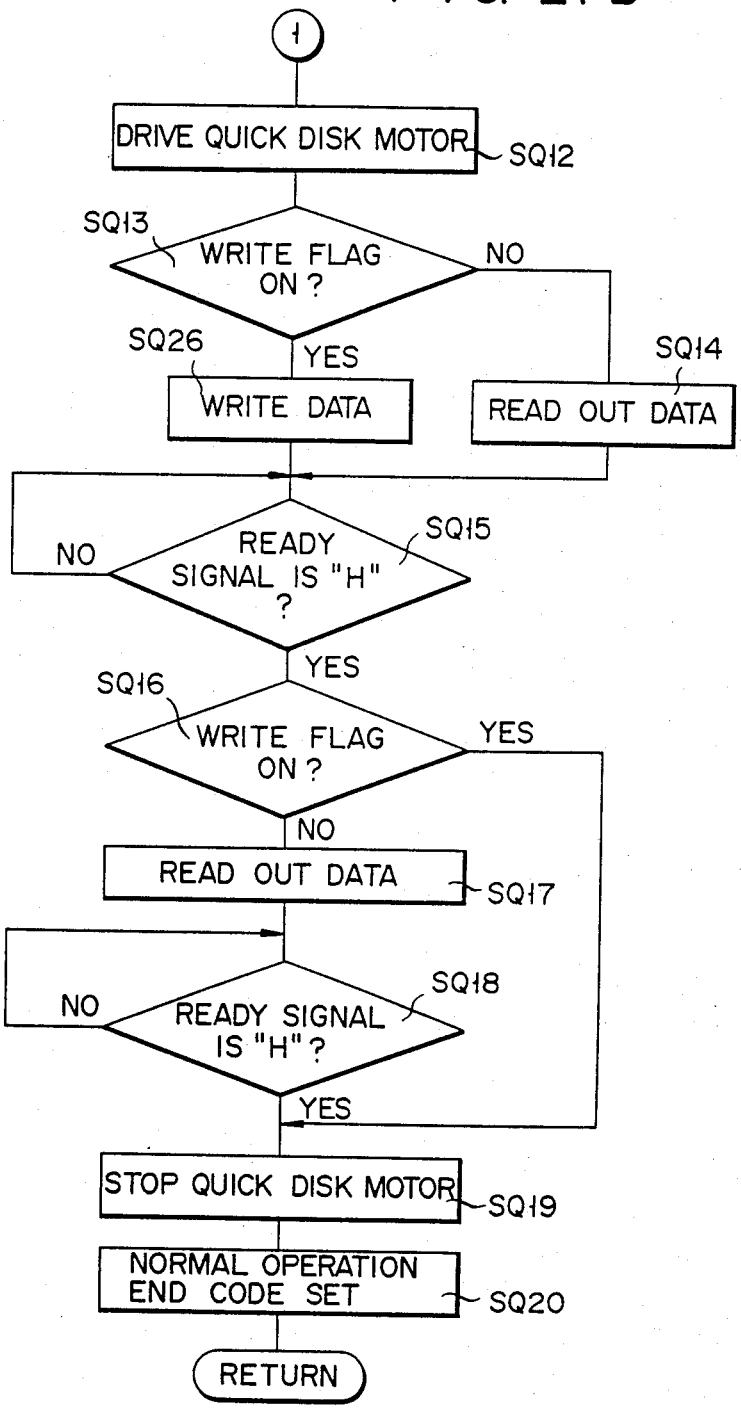

However, if YES in step SQ6 shown in FIG. 27A, i.e., if the ready signal is at high level "H", it is checked in step SQ10 if the write flag is ON. In this case, since the write flag is OFF as described above, a write gate signal is set at low level "L" in step SQ11, thus enabling data readout operation from quick disk Qd. Next, in step SQ12 shown in FIG. 27B, the flip-flop circuit of device 30 is set, and the motor is driven. It is checked in step SQ13 if the write flag is ON. If NO in SQ13, data stored in disk QD is read out in step SQ14. The readout data is stored in memory 142. When the readout operation is completed, device 30 generates the "H"-level ready signal, and it is checked in step SQ15 if the ready signal is at high level "H". If YES in step SQ15, it is checked in step SQ16 if the write flag is ON. In this case, since NO in step SQ16, the same data is read out again from quick disk Qd in steps SQ17 and SQ18. This procedure assures reliability of readout data. Thereafter, if it is determined in step SQ18 that the readout operation is completed, the motor of device 30 is stopped in step SQ19. A return code indicating a normal operation end is then set in step SQ20, and the control flow then shifts to step S3 in FIG. 26A.

The return code is checked in step S3 of FIG. 26A so as to discriminate if this portion of the quick disk subroutines ends normally. If NO in step S3, the flow advances to step S4 to check from the return code if the control can be recovered. If the control can be recovered (e.g., no quick disk state), the flow returns to step S1, and otherwise, the processing ends.

Figure 26B:
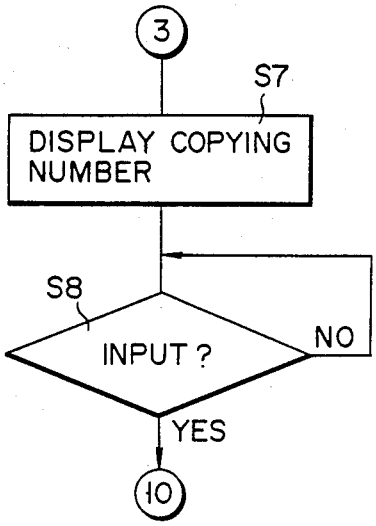

If YES in step S3, operation item data is read out from memory 142 in step S5, and is supplied to section $3_2$ through section 141. Thus, section $3_2$ displays respective operation item data corresponding to the operation of keys 3*a* to 3*d*, 3*r*, and 3*q*, as shown in FIG. 28A. When a desired setting key is depressed in this state, the operation mode is switched in accordance with the selected item, and display corresponding thereto is displayed on section $3_2$. For example, if setting key 3*a* is depressed, the control flow advances from step S6 to step S7 in FIG. 26B, and the apparatus is set in the copying number setting mode. In step S7, copying number display data is read out from memory 142, and is supplied to section $3_2$ through section 141. Thus, as shown in FIG. 28B, numerals are displayed to correspond with keys 3*e* to 3*n*, which then serve as ten keys. When any one of keys 3*e* to 3*n* is depressed in this state, the copying number corresponding to the depressed key is set in step S8, and the set number is displayed on section $3_2$. The flow advances to step S9 in FIG. 26F, and it is checked if copy key $3_1$ is depressed. If NO in step S9, the flow advances to step S5 in FIG. 26A. If YES in step S9, a normal copying operation in step S10 in FIG. 26F is performed.

Figure 26C:
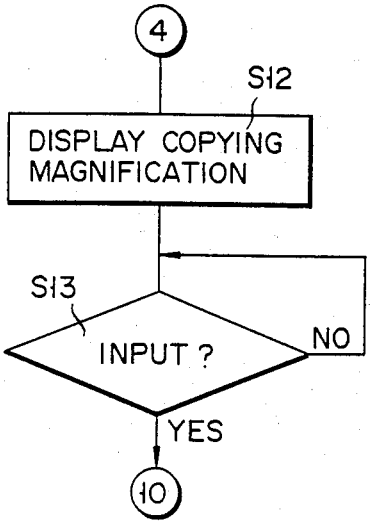

When setting key 3b is depressed in the display state shown in FIG. 28A, the flow advances from step S11 to step S12 in FIG. 26C, and the apparatus is switched to the copying magnification setting mode. In step S12, copying magnification data is read out from memory 142, and is supplied to section $3_2$ through section 141. As shown in FIG. 28C, copying magnifications are displayed to correspond with setting keys 3*a* to 3*d*, and 3*p* to 3*r*, which then serve as magnification setting keys. If any one of keys 3*a* to 3*d* and 3*p* to 3*r* is depressed in this state, a magnification corresponding to the depressed key is set in step S13 in FIG. 26C, and is displayed on section $3_2$. The flow advances to step S9 in FIG. 26F. When copy key $3_1$ is depressed (YES in step S9), the copying operation based on the magnification set is performed in step S10.

Figure 26D:
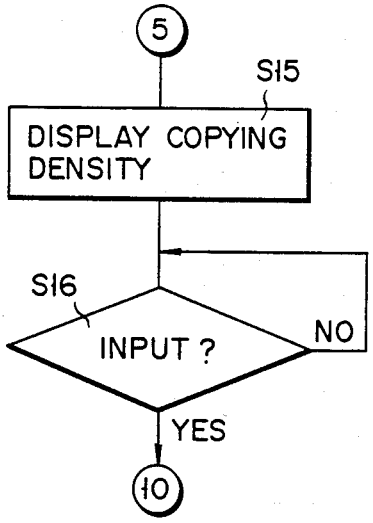

When setting key 3*c* is depressed in the display state shown in FIG. 28A, the flow advances from step S14 in FIG. 26A to step S15 shown in FIG. 26D, and the apparatus is set in the copying density setting mode. In step S15, copying density display data is read out from memory 142, and is supplied to section 3hd 2 through section 141. As shown in FIG. 28D, density display is performed to correspond with keys 3*h* and 3*j*. Every time key 3*h* is depressed, a copying density is decreased (becomes lighter) by one step, and every time key 3*j* is depressed, it is increased (becomes darker) by one step, in step S16. When key 3*h* or 3*j* is depressed, the flow returns from step S16 to step S9 in FIG. 26F. When key $3_1$ is then depressed, the copying operation based on the set density is performed.

Figure 26E:
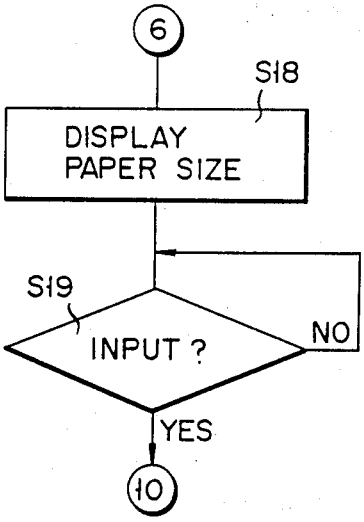
Figure 26F:
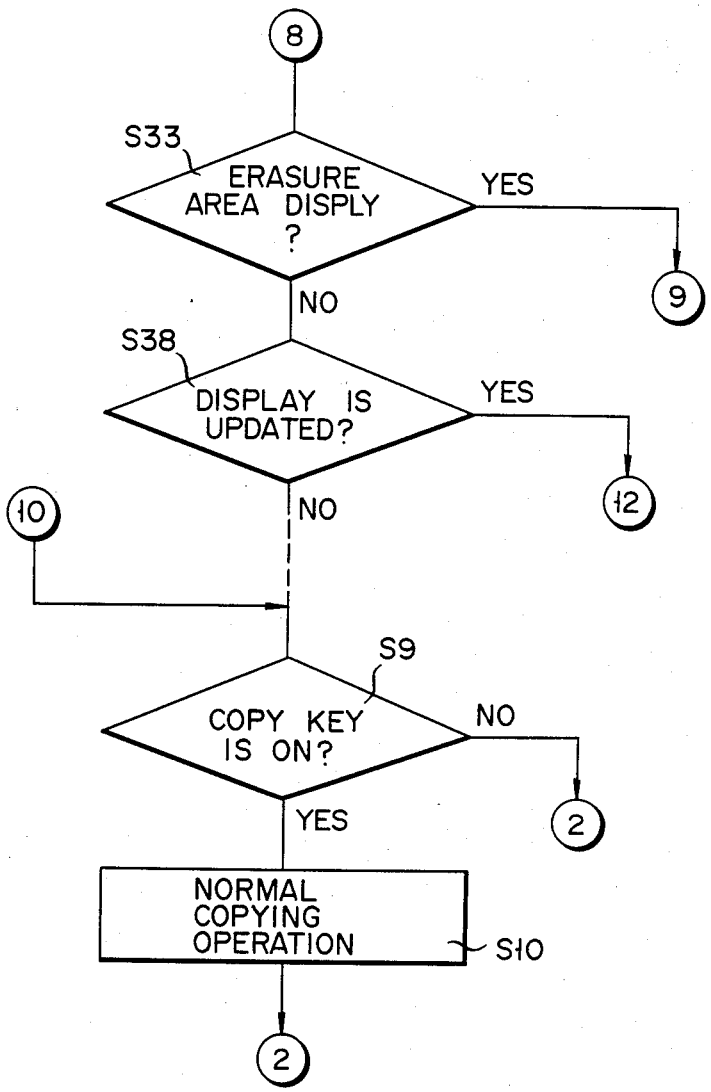

When setting key 3*d* is depressed in the state shown in FIG. 28A, the flow advances from step S17 in FIG. 26A to step S18 shown in FIG. 26E, and the apparatus is switched to the paper size setting mode. In step S18, paper size display data corresponding to a selected paper size is read out from memory 142 in response to the output signals from sensor switches $60_1$ and $60_2$. The readout data is supplied to section $3_2$ through section 141. As shown in FIG. 28E, section $3_2$ displays paper sizes to correspond with setting keys 3*b* and 3*cl*. *When either of keys 3b* and 3*c* is depressed in this state, the selected paper size is displayed on section $3_2$ in step S19, and the flow shifts from step S19 to step S9 in FIG. 26F. When key $3_1$ is depressed, the copying operation is performed using the selected paper size, in step S10.

When setting key 3*r* is depressed in the state shown in FIG. 28A, the flow advances from step S20 in FIG.

Figure 26G:
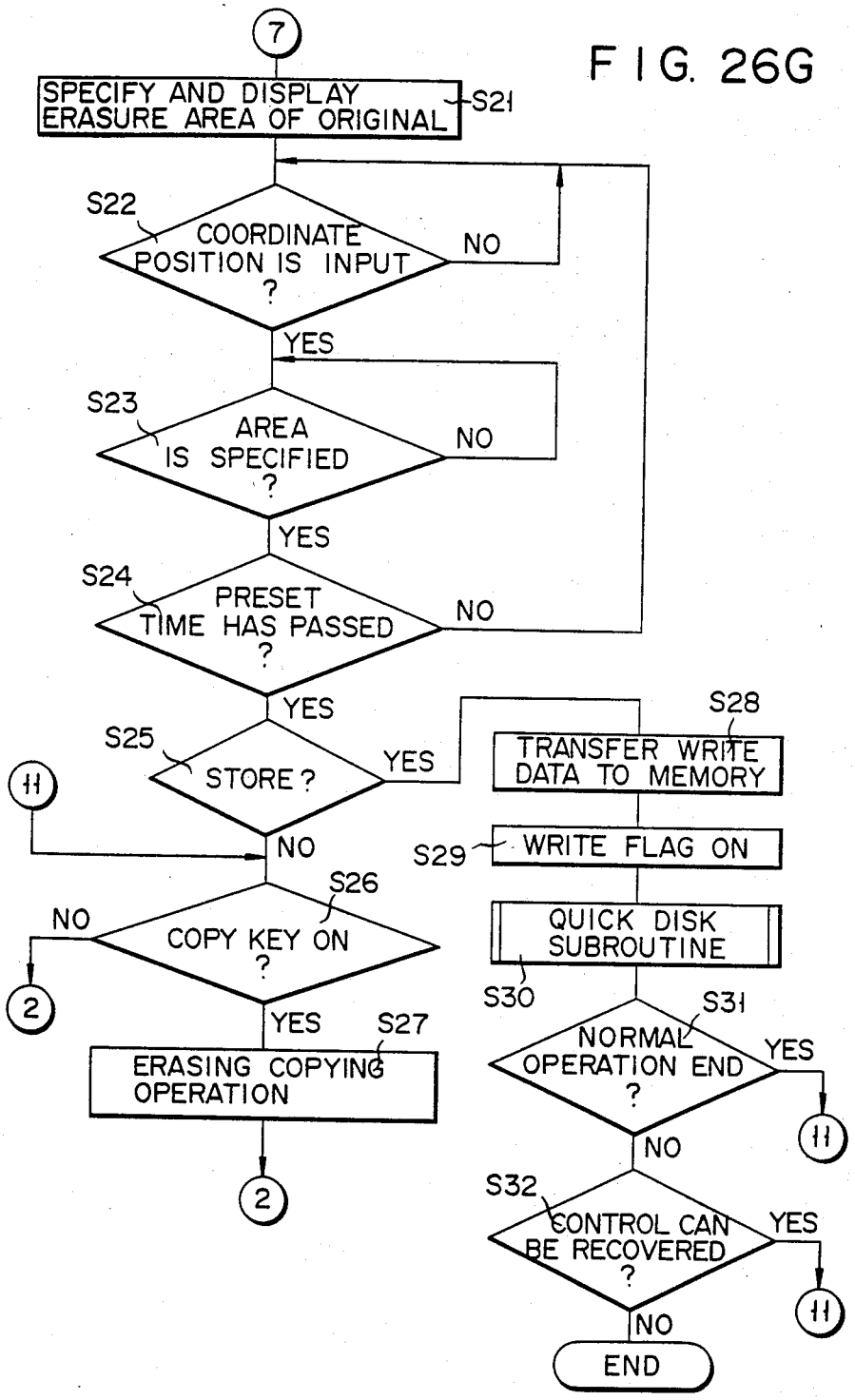

26A to step S21 in FIG. 26G, and the apparatus is set in the erasure mode of an unnecessary portion of an original. In step S21, erasure area specifying display data is read out from memory 142, and erasure area specifying display is displyed on section $3_2$, as shown in FIG. 28F. Setting keys 3*c* and 3*p* serve as erasure area specifying keys. In this state, when spot light source 131 is shifted by operating keys 3*s* to 3*v*, as previously described, and a desired coordinate position is input by position specifying key 3*w*, the flow advances from step S22 to step S23. If it is determined in step S23 that the erasure area is specified by key 3*c* or 3*p*, it is checked in step S24 if a preset period of time has passed. If NO in step S24, the flow returns to step S22, and if YES in step S24, it is checked in step S25 if key 3*r* is depressed. Depression of key 3*r* designates whether or not the specified coordinate position data and erasure area specifying data are stored in quick disk Qd. If it is determined that key 3*r* is not depressed (NO in step S25) so as not to store data in disk Qd, the flow advances to step S26 to check if key $3_1$ is depressed. If NO in step S26, the flow advances to step S5 in FIG. 26A, and if YES in step S26, the flow advances to step S27 in FIG. 26G. In step S27, an erasure copying operation of the original is performed based on the selected copying number, paper size, and magnification. After the operation is completed, the flow shifts to step S5 in FIG. 26A.

If YES in step S25 in FIG. 26G, however, the flow advances to step S28 in which the coordinate position and erasure area data for determining if the erasure area is inside or outside the specified area, which is stored in group 71, is written at a predetermined address in memory 142. In step S29, the write flag is turned on, and the control flow enters the quick disk subroutine in step S30.

In the quick disk subroutine shown in FIG. 27A, after steps SQ1, SQ5 and SQ6, it is checked in step SQ10 if the write flag is ON. Since YES in step SQ10 in this case, it is checked in step SQ21 if loaded quick disk Qd is write-protected. If YES in step SQ21, a message "replace quick disk" stored in group 71 is supplied to section $3_2$ through section 141, thus displaying the message in step SQ22. In step SQ23, the apparatus stands by for, e.g., 30 seconds, and if disk Qd is replaced during this interval, the flow returns to step SQ21. However, if YES in step SQ23, a return code indicating an abnormality end is set in step SQ24, and the flow shifts to step S31 in FIG. 26G.

If NO in step SQ21 in FIG. 26G, the write gate signal is set at high level "H" in step SQ25, and the data write operation for disk Qd is enabled. Thereafter, in step SQ12 in FIG. 27B, the motor of device 30 is driven, and it is confirmed in step SQ13 that the write flag is ON. Then, in step SQ26, the data stored in memory 142 is written in disk Qd. If it is determined that all the data is written and the ready signal goes to high level in step SQ15, the flow advances to step SQ16, and it is checked if the write flag is ON. Since YES in step SQ16, the flow advances to step SQ19, and the motor of device 30 is stopped. Thereafter, a return code indicating a normal operation end is set in step SQ20, and the flow shifts to step S31 in FIG. 26G.

The return code is checked in step S31. If YES in step S31, the flow shifts to step S26, and if NO, it is checked in step S32 if the control can be recovered. If YES in step S32, the flow advances to step S26, and if NO, the flow ends.

Figure 26H:
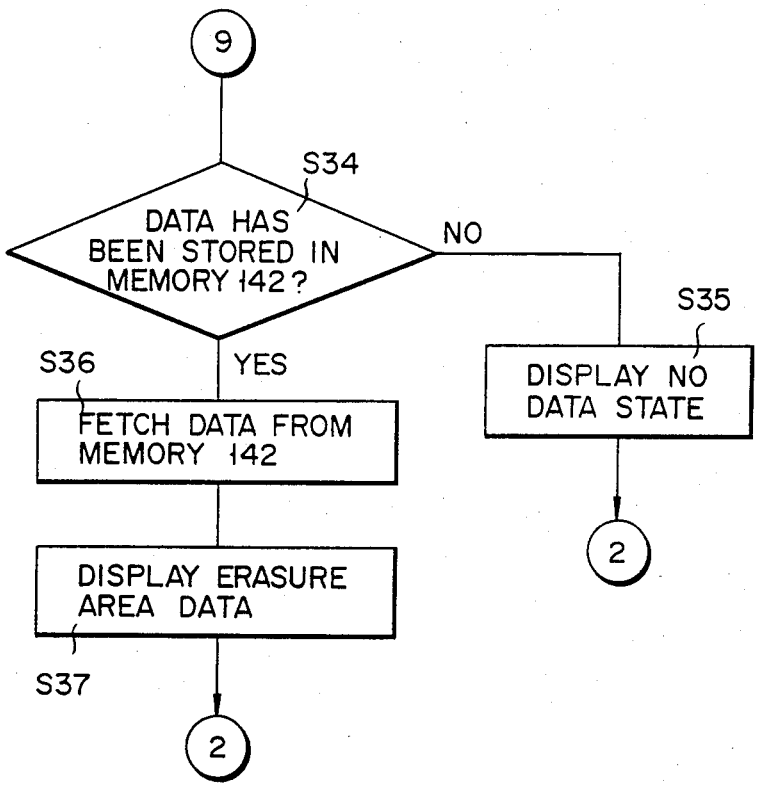

When setting key 3*q* for designating erasure area display is depressed in the state shown in FIG. 28A, the flow advances from step S33 in FIG. 26F to step S34 in FIG. 26H, thus setting the erasure area display mode. It is checked in step S34 if the coordinate position data and erasure area specifying data are stored at predetermined addresses of memory 142. If NO in step S34, the flow advances to step S35. In step S35, display data indicating "erasure data not found" stored in group 71 is read out, and is supplied to section $3_2$ through section 141, so as to be displayed thereon. After disk Qd has been replaced, the flow shifts to step Sl shown in FIG. 26A, and otherwise, the flow advances to step S5.

Figure 28G:
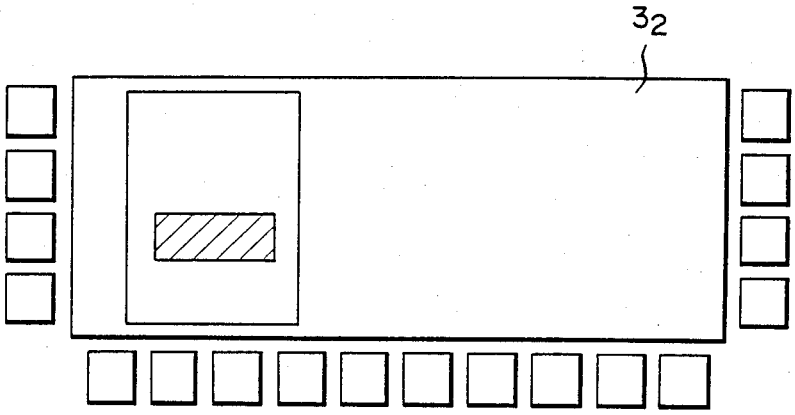
Figure 28H:
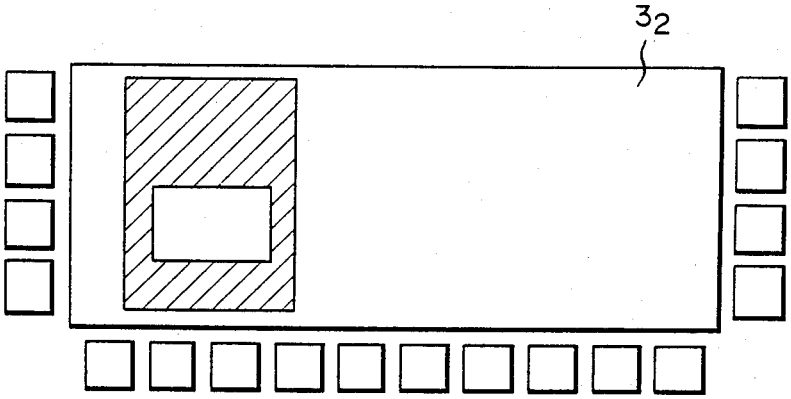

If YES in step S34, the desired data is read out from memory 142 in step S36, and is supplied to group 71. In group 71, display data similar to those shown in FIGS. 20A and 20B are stored in memory 140 based on the supplied coordinate position and erasure area specifying data. The display data is sequentially read out from memory 140 in step S37, and is supplied to section $3_2$ through section 141. In this way, the erasure area is displayed on section $3_2$, as shown in FIGS. 28G or 28H.

At the same time, first carriage $41_1$ and spot light source 131 are driven under the control of group 71 in accordance with the coordinate position data supplied.

Figure 29:
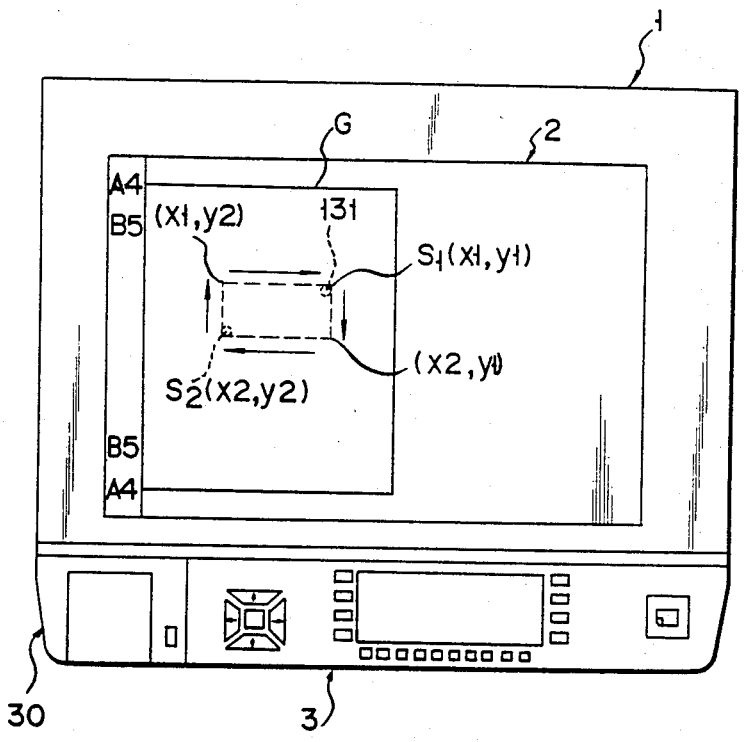

Assume that a specified erasure area is defined by coordinates S1(x1,y1) and S2(x2,y2), as shown in FIG. 29. Spot light source 131 is shifted to stored coordinate position S1(x1,y1). In doing this, an illumination signal is supplied to light emitting element 132 from main processor group 71, so as to turn it on. First carriage $41_1$ and spot light source 131 are then driven, and the spot light is shifted in the directions indicated by arrows in FIG. 29. More specifically, carriage $41_1$ is driven so that spot light source 131 is shifted from coordinate position S1(x1,y1) to (x2,y1) and then from position (x2,y1) to S2(x2,y2). Thereafter, carriage $41_1$ is driven so that the spot light is shifted to position (x1,y2) and finally, from position (x1,y2) to starting position S1(x1,y1). In this way, the erasure area is indicated. When light source 131 again reaches position S1, light emitting element 132 is turned off.

When a plurality of erasure areas are specified, after a certain erasure area has been indicated, light source 131 is shifted to the coordinate position of the next specified erasure area, and this is indicated in the same manner as above.

After the erasure area has been displayed for a predetermined period of time, the flow advances to step S5 in FIG. 26A.

When not setting keys 3*a* to 3*d*, 3*q*, and 3*r*and depressing copy key $3_1$ in the state shown in FIG. 28A, the flow advances from step S9 in FIG. 26F to step S10, and a single equal-magnification copying operation is performed using, e.g., an A4-size paper sheet. When the operation is completed, the flow shifts to step S5 in FIG. 26A.

Figures 1, 26I:
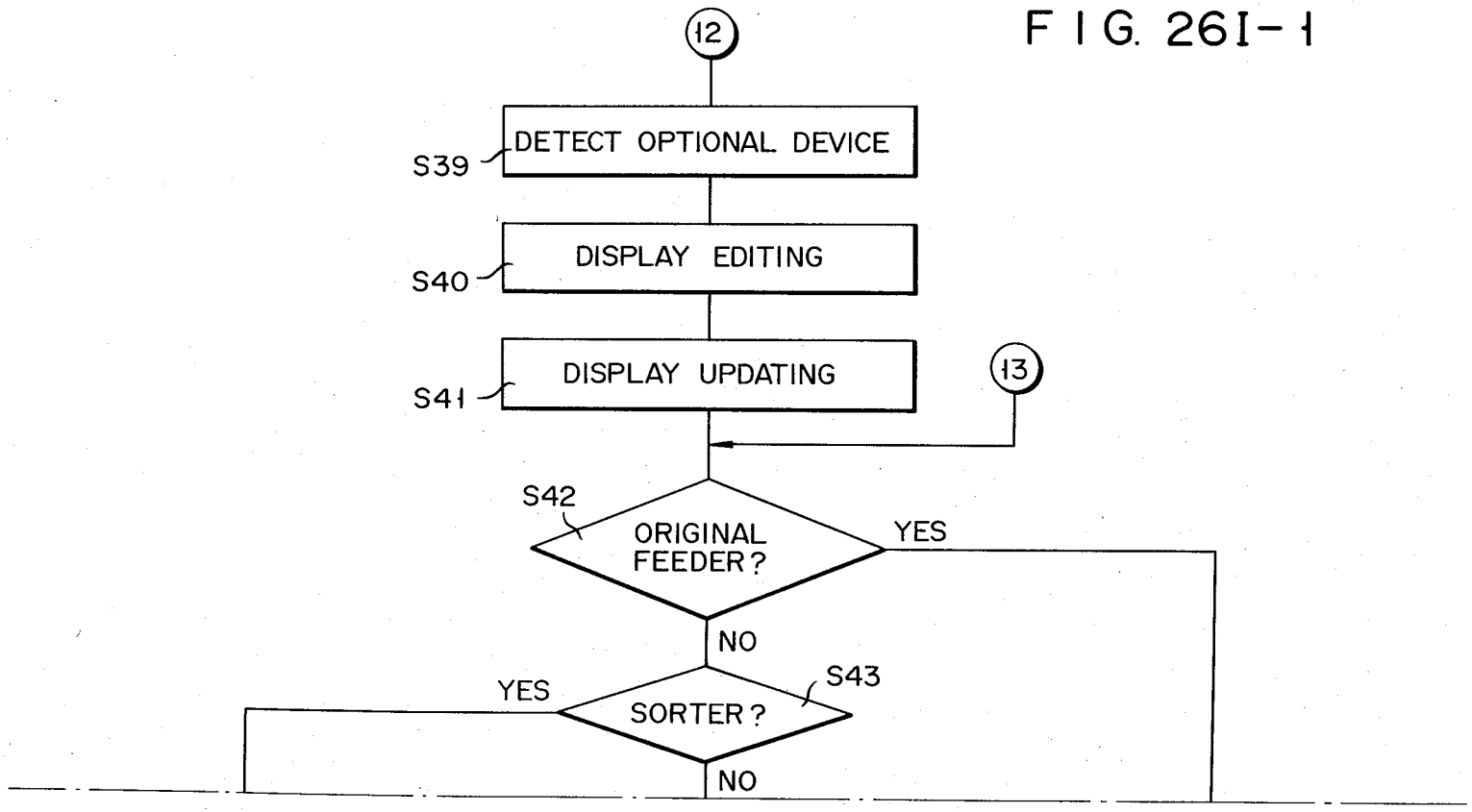
Figures 2, 26I:
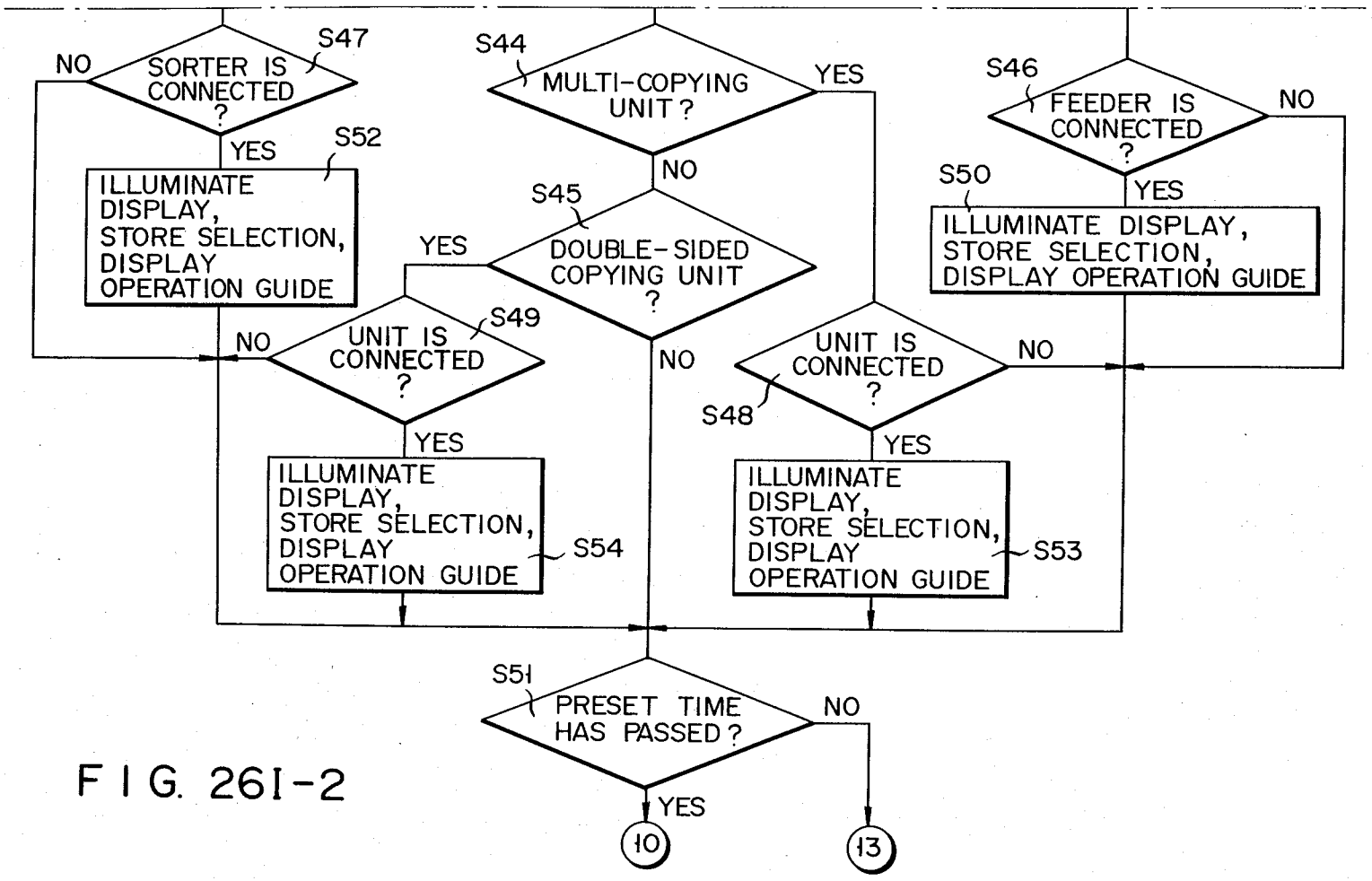
Figure 30A:
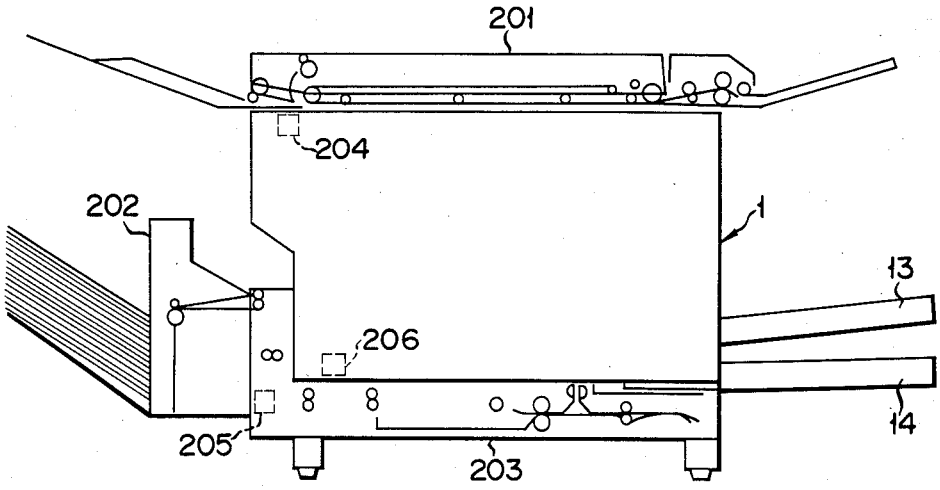
FIGS. 30A and 30B are side sectional views showing different optional devices connected to the apparatus.
Figure 31:
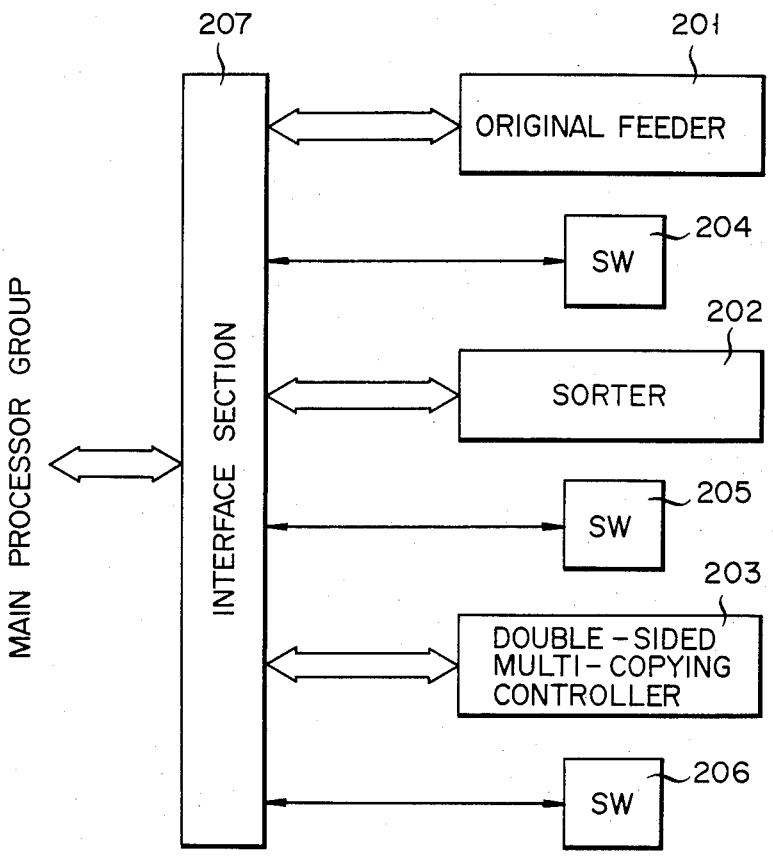

When setting key 3*p* for updating a display is depressed in the state shown in FIG. 28A, the control flow advances from step S38 in FIG. 26F to step S39 in FIG. 26I. In step S39, an optional device connected to housing 1 is detected. More specifically, as shown in FIG. 30A, microswitches 204, 205, and 206 for respectively detecting original feeder 201, sorter 202, and double-sided multi-copying unit 203 are arranged in housing 1 and unit 203. When the corresponding optional device is detected by microswitch 204, 205, or 206, the detection output signal therefrom is supplied to main processor group 71 through interface section 207, as shown in FIG. 31. Group 71 discriminates from the detection output signal which optional device is connected. In step S40 in FIG. 26I, operation guide data associated with the connected optional device stored in memory 142 is edited. The edited operation guide data is supplied to display section $3_2$ through display control section 141, in step S41. When feeder 201, sorter 202, and unit 203 are connected to housing 1 as shown in FIG. 30A, displays P1, P2, and P3 illustrating them and selection displays, corresponding to keys 3r to 3o, for selecting the optional devices are displayed as shown in FIG. 28I.

Figure 30B:
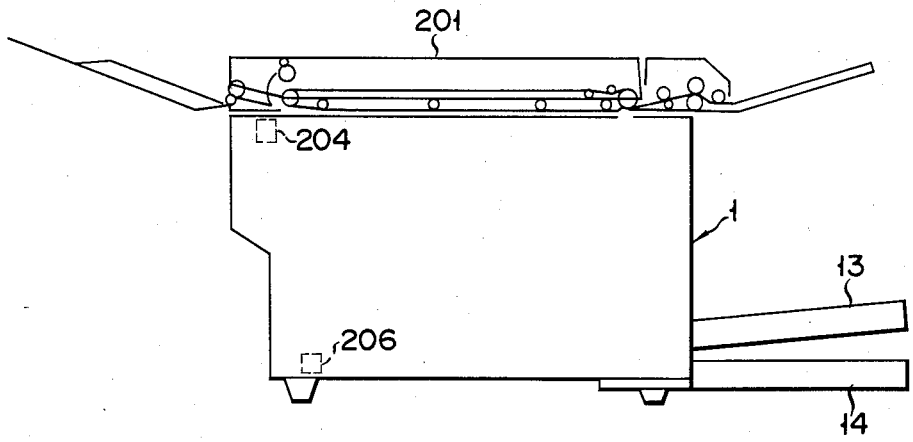

For example, when only feeder 201 is connected to housing 1, as shown in FIG. 30B, the operation guide data is edited in accordance therewith in step S40 in FIG. 26I, and is displayed in step S41. Therefore, as shown in FIG. 28L, display P1 illustrating feeder 201 and a display indicating it to correspond with key 3r are displayed on section $3_2$.

Figure 28I:
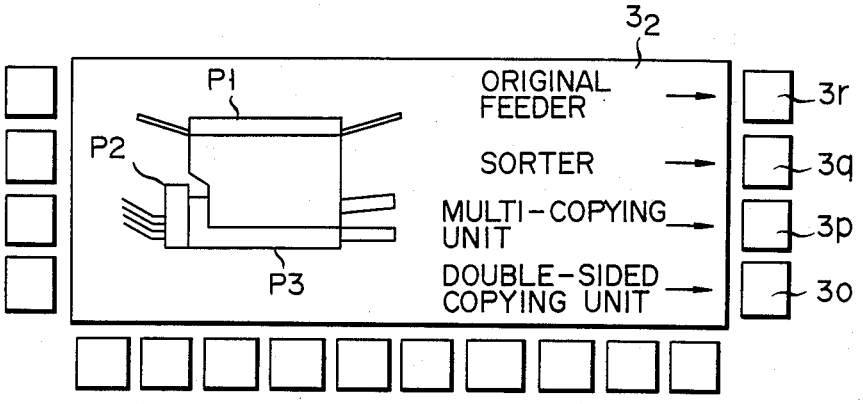
Figure 28J:
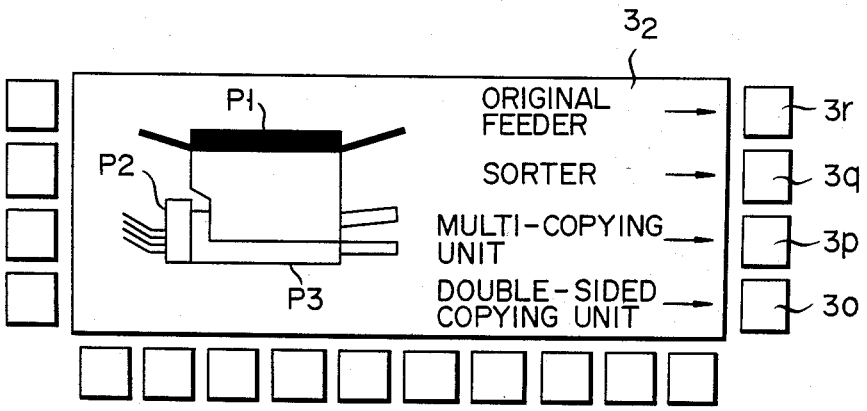

When any one of keys 3r to 3o is operated in step S41 in the state shown in FIG. 28I, the control flows respectively advance from steps S42 to S45 (FIG. 26I) to steps S46 to S49, and the displays are illuminated and various setting operations are made in accordance with the presence/absence of the corresponding optional devices. More specifically, when key 3r is depressed, the flow advances from step S42 to S46. In step S46, the presence/absence of feeder 201 is checked from the output signal from microswitch 204. In this case, since YES in step S46, the flow advances to step S50. In step S50, display P1 displayed on section $3_2$ is entirely illuminated under the control of group 71 through section 141, as shown in FIG. 28J. At the same time, group 71 stores the fact that feeder 201 is selected.

Figure 28K:
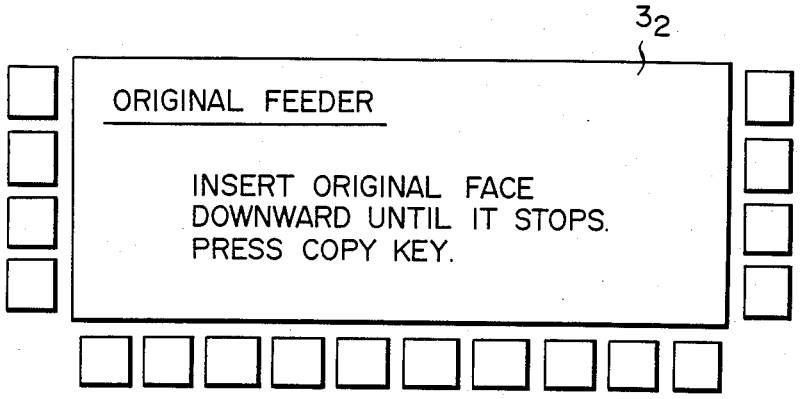
Figure 28L:
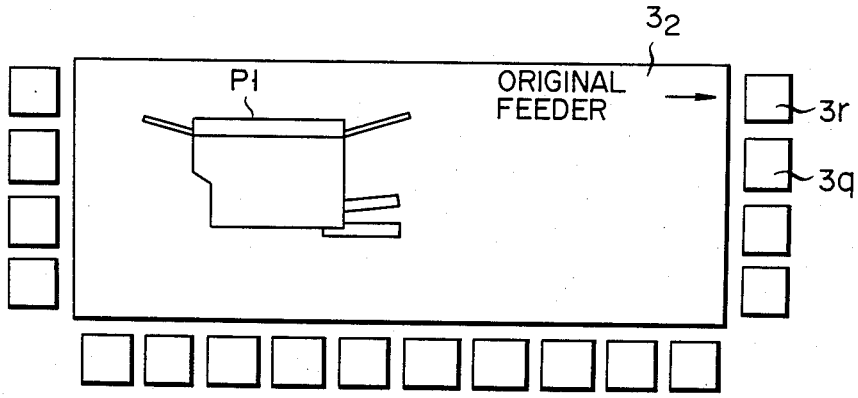

In addition, when the display shown in FIG. 28J is displayed for a predetermined period of time, the operation guide data associated with feeder 201 is read out from memory 142, and is supplied to section $3_2$ through section 141. The operation guide is thus displayed on section $3_2$, as shown in FIG. 28K, and is kept displayed for a predetermined period of time. After the predetermined period of time has passed, the display is returned to the state shown in FIG. 28J.

It is checked in step S51 if the preset time has passed. If NO in step S51, the flow returns to step S42 in FIG. 26I, and the same operation as above is performed through steps S52, S53, and S54 upon operation of keys 3q to 3o, respectively. If YES in step S51, the flow advances to step S9 in FIG. 26H.

After the optional device is selected and copy key $3_1$ is depressed, group 71 generates a drive signal in synchronism with the copying operation, and the drive signal is supplied to feeder 201, sorter 202, and unit 203 through interface section 207 shown in FIG. 31, thus performing a predetermined operation.

When setting key 3q is depressed upon the display of section $3_2$ shown in FIG. 28L, the control advances through steps S43, S47, and S51 in FIG. 26I, and display illumination operation, selection storing operation, and operation guide display operation are omitted.

When not setting keys 3a to 3d, 3q or 3r and depressed copy key $3_1$ is depressed in the state shown in FIG. 28A, the flow advances from step S9 in FIG. 26F to step S10, and an equal-size copying operation is performed for a single paper sheet using, e.g., an A4 size paper sheet. After the copying operation is completed, the control flow advances to step S5 in FIG. 26A.

With the image forming apparatus of this embodiment, operation guide data for the optional devices prestored in quick disk Qd is read out by quick disk device 30, and is displayed on section $3_2$ as needed. When a setting key corresponding to the display is operated, the required optional device can be selectively operated. Therefore, even if the optional devices are connected to the apparatus, since display section $3_2$ and the setting keys can also be used in other operation modes, the number of setting keys and parts for display section $3_2$ can be decreased, thus simplifying the arrangement of operation panel 3 and allowing easy operation.

Microswitches 204, 205, and 206 for detecting the optional devices are arranged in housing 1, and the operation guide data is read out in accordance with the output signals therefrom, so that data corresponding to the optional devices connected can be displayed on section $3_2$. Therefore, an operator need only observe display section $3_2$ to recognize which optional devices are connected to the apparatus, thus preventing erroneous operation.

If it is determined in step S3 in FIG. 26A that the quick disk subroutine has ended normally, it is checked in step SE1 in FIG. 26A, by detecting a file name (not shown) stored in memory 140, whether or not the currently loaded quick disk Qd stores corresponding installation data.

Figure 26J:
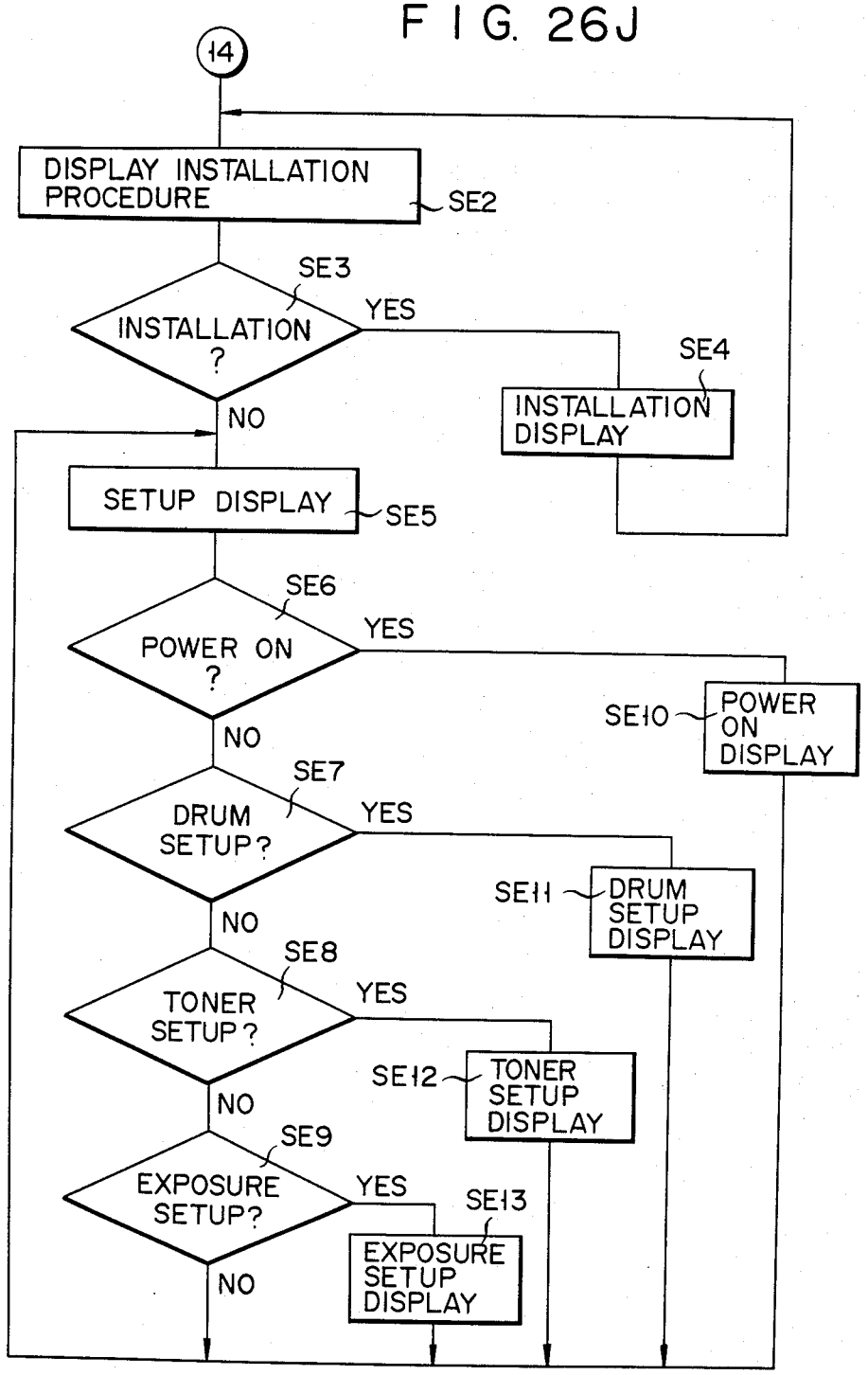
Figure 28M:
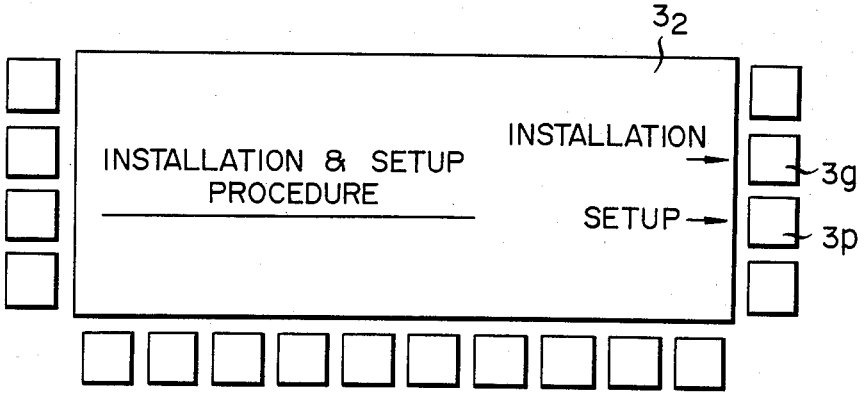

If YES in step SE1, the flow advances to step SE2 in FIG. 26J. In step SE2, installation procedure data is read out from memory 142, and is supplied to section $3_2$ through section 141. Therefore, the installation procedure data is displayed together with a message to correspond with setting keys 3q and 3p, as shown in FIG. 28M. When setting key 3q is depressed in this state, the control flow advances from step SE3 to step SE4 in FIG. 26J, and installation explanation data is read out from memory 142 and is displayed on section $3_2$. After a predetermined period of time has passed, the flow returns to step SE2.

Figure 28N:
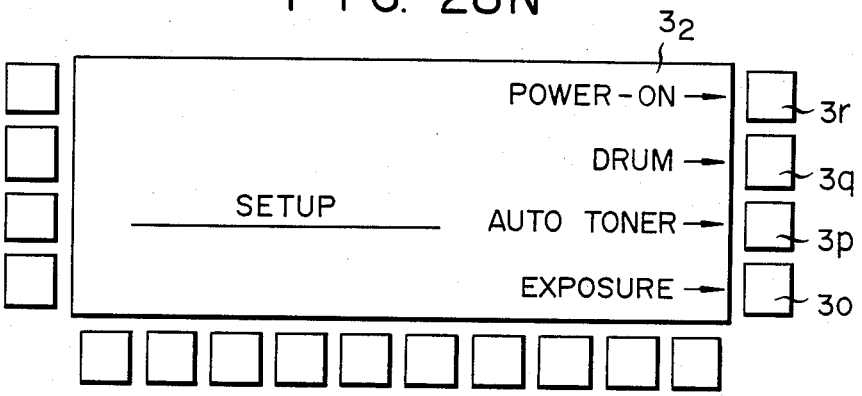

On the other hand, when key 3p is depressed in step SE3, the flow advances to step SE5, and setup data is read out from memory 142 so as to be displayed on section $3_2$, as shown in FIG. 28N. In this state, when keys 3o to 3r are selectively operated, the control flow advances from steps SE6 to SE9 in FIG. 26J, respectively, to corresponding steps SE10 to SE13 and the display data necessary for a given setup procedure is read out from memory 142 to be displayed on section $3_2$. After the display operation in steps SE10 to SE13 is completed or if none of keys 3o to 3r is depressed, the flow advances to step SE5. This installation display is kept displayed until quick disk Qd storing installation/setup data is replaced with another one.

With the above embodiment, display data for explaining the copying machine installation procedure is prestored in quick disk Qd, and is read out by quick disk device 30 so as to be displayed on display section $3_2$. Therefore, installation/setup display data on section $3_2$ need only be switched, and the installation/setup operation can be easily performed in accordance therewith.

A method for changing languages of display messages on display section $3_2$ will be described hereinafter. Display section $3_2$ can display operation guides or the like in different languages. More specifically, the operation guides or the like expressed in different languages are stored in different quick disks Qd for each desired language. When quick disk Qd in a desired language is loaded in quick disk device 30, data stored therein is read out in the above-mentioned operation, and section $3_2$ displays the operation guides or the like in the required language.

Figure 28O:
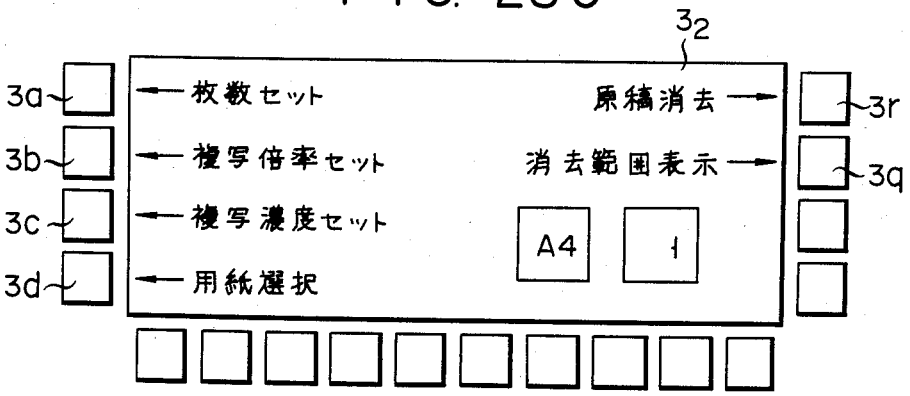

FIG. 28O shows a modification of the display shown in FIG. 28A, which is expressed in Japanese.

With the above embodiment, quick disk device 30 and display section $3_2$ comprising a liquid crystal dot matrix display are arranged on housing 1. When quick disks Qd storing operation guides or the like expressed in different languages are loaded in device 30, the operation guides in different languages can be selectively displayed on display section $3_2$. Since appropriate displays can be made for operators who speak various languages, operation can be simplified, resulting in great practical advantages.

According to this embodiment, when the display data (e.g., the operation items) stored in disk Qd is displayed on section $3_2$, and the setting key corresponding to the desired item is depressed, the operation mode of housing 1 can be changed. Therefore, a single setting key with different functions can be provided, and section $3_2$ can display different displays in accordance with the selected operation mode. Thus, the number of setting keys and parts for section $3_2$ can be decreased, thus simplifying the arrangement of control panel 3.

An operation quide message is displayed on section $3_2$ in accordance with the selected operation mode, thus allowing easy operation.

Since quick disk device 30 is included in panel 3, the size of housing 1 can be reduced. In addition, device 30 is separated from magnetic devices (e.g., a developing section of the apparatus), thus protecting the storage content of disk Qd.

If a display content stored in disk Qd is changed, its content can be expressed in Japanese or English, in detail or in simple words. Therefore, the display content can be easily changed to meet customer's requirements.

Furthermore, since device 30 is detachably mounted on housing 1, it can be replaced with other data equipment.

Since container $1_4$ as a sealed structure is formed in the front surface of housing 1, quick disks Qd stored therein are protected from adverse magnetic influences, and are within easy access of device 30.

Display section $3_2$ comprises a dot matrix display, allowing various types of display.

With the apparatus of the present invention, an unnecessary portion of an original can be erased, allowing convenient editing of copied images.

Since specified erasure area data can be stored in a quick disk, the stored data can be reused when an identical unnecessary portion of an original is repeatedly erased during copying.

In addition, since erasure area data stored in a quick disk can be displayed on section $3_2$, an erasure area of an original can be confirmed thereon.

Furthermore, since spot light source 131 is driven in accordance with erasure area data stored in a quick disk, and an erasure area is indicated on original table 2, the specified erasure area can be clearly determined.

Figure 32:
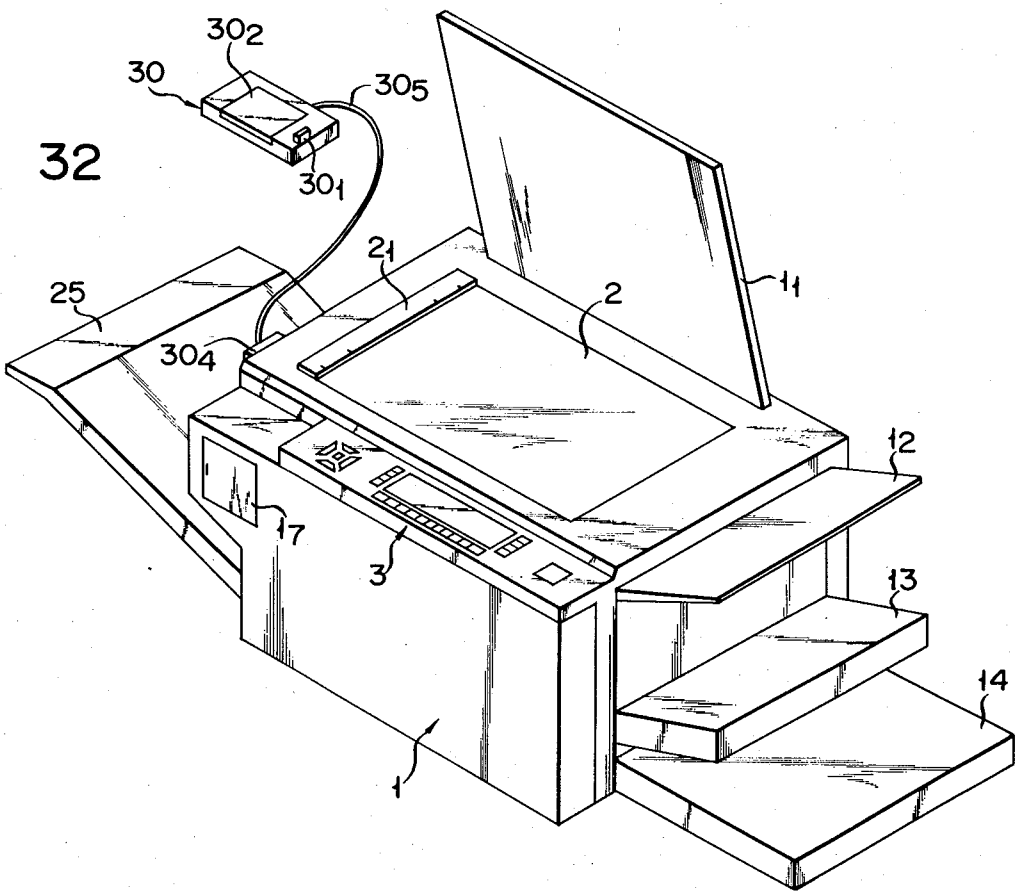
FIG. 32 is a schematic perspective view showing a modification of a quick disk device.

Note that the present invention is not limited to the above embodiment. In the above embodiment, connection terminal $30_3$ is provided for quick disk device 30, and is connected and disconnected to and from insertion hole $1_3$ of housing 1. As shown in FIG. 32, however, cord $30_5$ having connector $30_4$ can be provided for device 30, and connector $30_4$ can be connected to housing 1. With this arrangement, compatibility between device 30 and other data equipment can be improved.

Figure 33:
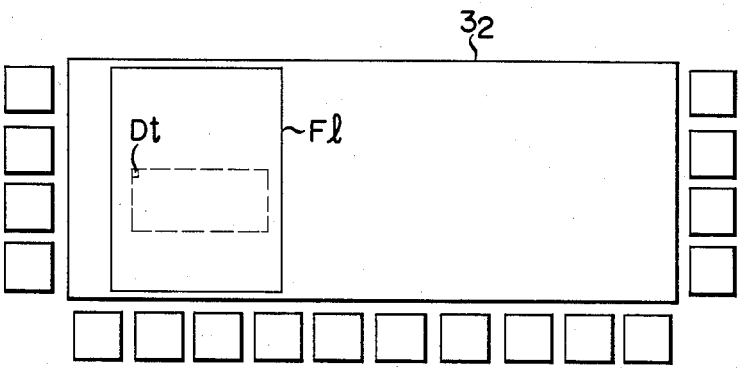
FIG. 33 is a plan view of the main part of a control panel for explaining a modification of the erasure area display operation.

Upon confirmation of an erasure area, spot light source 131 is driven while it is turned on. However, as shown in FIG. 33, dot Dt corresponding to light source 131 and frame F1 corresponding to an original are displayed on section $3_2$. Dot Dt can be operated to specify the erasure area, as indicated by the dotted line.

Figure 21B:
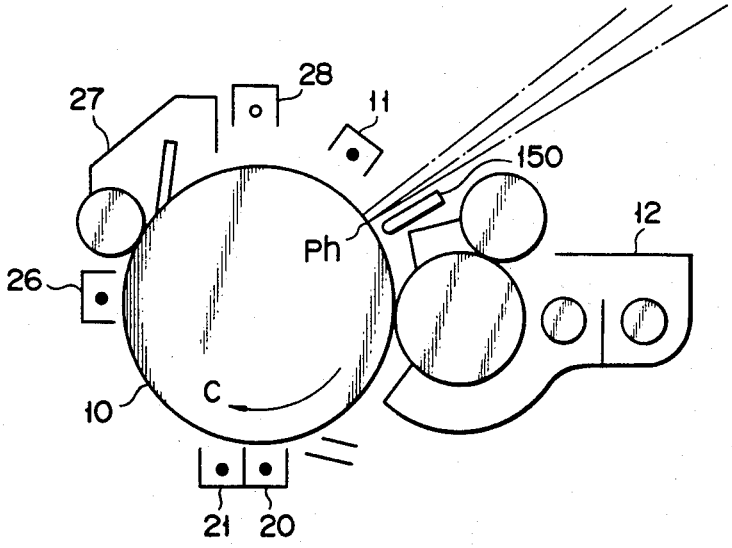

Erasure array 150 need not be interposed between charger 11 and exposure section Ph, as shown in FIG. 21A, but can be interposed between exposure section Ph and developing unit 12, as shown in FIG. 21B, so that a latent image formed is erased in accordance with the erasure area designation.

Various other changes and modifications may be made within the spirit and scope of the invention.

According to the present invention as described above, an image forming apparatus with multi-functions can be provided wherein the number of operation keys is decreased so as to simplify operation and parts-control.

Even if optional devices are connected to the image forming apparatus, the arrangement of the operation panel is simplified, allowing easy operation and preventing erroneous copying. In addition, installation/setup procedures can be easily understood, thus shortening the time required therefor. Furthermore, operation guides or the like can be displayed in desired languages, thus providing practical advantages.

What is claimed is:

1. An image forming apparatus with an operation panel control function, said apparatus comprising:

a housing including original scanning means for optically scanning an original placed on an original table so as to obtain otpical image data, and image forming means for transferring the optical image data obtained by said original scanning means onto an image forming medium;

an operation panel provided to said housing, said operation panel having a dot matrix display, a plurality of operation members, which are arranged along the periphery of said dot matrix display and which can change functions corresponding to the contents of said dot matrix display, and a data reader which can read out data from a data recording medium, said data recording medium being detachably inserted into said data reader for selectively storing at least first operation data necessary for normal image forming operations and second operation data necessary for operations other than the normal image forming operations;

first control means for selectively receiving the first and second operation data read out, by said data reader, from said data recording medium and supplying the received operation data to said dot matrix display for data display according to the received operation data and for changing functions of said plurality of operation members; and second control means for receiving operation instructions when said operation members are selectively operated, and for controlling said housing and said operation panel for the normal image forming operations or controlling, for the operation other than the normal image forming operations, that portion of said apparatus which is needed to perform the operations other than the normal image forming operations.

2. An apparatus according to claim 1, wherein said first and second control means include a storage section for storing operation data necessary for at least one required operation of said apparatus.

3. An apparatus according to claim 2, wherein said dot matrix display can display the operation data stored in said storage section.

4. An apparatus according to claim 1, wherein the second operation data stored in said data recording medium is installation/setup procedure data for said apparatus.

5. An apparatus according to claim 1, wherein said data recording medium stores operation guide data for at least one optional device selectively connected to said apparatus.

6. An apparatus according to claim 5, wherein said apparatus further comprises detection means for detecting whether or not said optional device is connected and optional device operation control means for selectively reading out the operation guide data corresponding to said optional device detected by said detection means from said data recording medium, so as to display the read-out data on said dot matrix display.

* * * * *